US009937734B2

(12) United States Patent
Beier et al.

(10) Patent No.: US 9,937,734 B2
(45) Date of Patent: Apr. 10, 2018

(54) METHOD FOR THE INDIRECT APPLICATION OF PRINTING LIQUID ONTO A PRINTING MATERIAL

(71) Applicant: HEIDELBERGER DRUCKMASCHINEN AG, Heidelberg (DE)

(72) Inventors: Bernard Beier, Ladenburg (DE); Martin Greive, Schriesheim (DE); Peter Hachmann, Weinheim-Hohensachsen (DE); Axel Hauck, Karlsruhe (DE); Rolf Kuendgen, Bad Schoenborn (DE); Albert Maul, Heidelberg (DE); Rolf Mueller, Nussloch (DE); Heiner Pitz, Weinheim (DE); Achim Scheurer, Bellheim (DE); Matthias Schloerholz, Plankstadt (DE); Michael Schwandt, Forst (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/047,177

(22) Filed: Feb. 18, 2016

(65) Prior Publication Data

US 2016/0159110 A1 Jun. 9, 2016

Related U.S. Application Data

(60) Division of application No. 14/570,479, filed on Dec. 15, 2014, now abandoned, which is a continuation of (Continued)

(30) Foreign Application Priority Data

Jun. 15, 2012 (DE) ..... 10 2012 011 780
Jun. 15, 2012 (DE) ..... 10 2012 011 781

(Continued)

(51) Int. Cl.
*B41J 11/00* (2006.01)
*B41J 2/005* (2006.01)

(52) U.S. Cl.
CPC ..... *B41J 11/002* (2013.01); *B41J 2/0057* (2013.01)

(58) Field of Classification Search
CPC ..... B41J 2/0057
See application file for complete search history.

(56) References Cited

U.S. PATENT DOCUMENTS 4,706,460 A 11/1987 Kervagoret
5,623,296 A 4/1997 Fujino et al.

(Continued)

FOREIGN PATENT DOCUMENTS

EP 0993378 B1 9/2001
JP H06122194 A 5/1994

(Continued)

*Primary Examiner* — Stephen Meier
*Assistant Examiner* — John P Zimmermann
(74) *Attorney, Agent, or Firm* — Laurence A. Greenberg; Werner H. Stemer; Ralph E. Locher

(57) ABSTRACT

A method for the indirect application of printing liquid onto a printing material provides an intermediate carrier, preferably a circulating belt, a liquid conditioning medium including a first substance applied onto the intermediate carrier and a printing liquid, in particular an inkjet ink, including a second substance applied onto the conditioning medium on the intermediate carrier. The printing liquid is situated as droplets or a layer substantially on the conditioning medium and the droplets or the layer form a contact region on their (Continued)

underside with the conditioning medium. The printing liquid is heated, preferably by way of a dryer and the printing liquid is transferred from the intermediate carrier onto the printing material.

44 Claims, 11 Drawing Sheets

Related U.S. Application Data application No. PCT/EP2013/001750, filed on Jun. 13, 2013.

(30) Foreign Application Priority Data

| | | |
|---|---|---|
| Jun. 15, 2012 | (DE) | 10 2012 011 782 |
| Jun. 15, 2012 | (DE) | 10 2012 011 783 |
| Jul. 20, 2012 | (DE) | 10 2012 014 409 |
| Oct. 11, 2012 | (DE) | 10 2012 019 953 |
| Nov. 9, 2012 | (DE) | 10 2012 021 983 |
| Nov. 9, 2012 | (DE) | 10 2012 021 984 |
| Nov. 30, 2012 | (DE) | 10 2012 023 389 |
| Dec. 13, 2012 | (DE) | 10 2012 024 393 |
| Feb. 4, 2013 | (DE) | 10 2013 001 825 |

(56) References Cited

U.S. PATENT DOCUMENTS

| | | | | |
|---|---|---|---|---|
| 6,562,413 | B1 | 5/2003 | Morgavi | |
| 6,857,734 | B2 | 2/2005 | Yamamoto | |
| 6,932,470 | B2 | 8/2005 | Pan et al. | |
| 7,682,014 | B2 | 3/2010 | Snyder et al. | |
| 7,997,717 | B2 | 8/2011 | Taniuchi et al. | |
| 8,025,388 | B2 | 9/2011 | Kadomatsu et al. | |
| 8,422,926 | B2 | 4/2013 | LeFevre et al. | |
| 8,515,256 | B2 | 8/2013 | Fukumoto et al. | |
| 8,939,573 | B2 | 1/2015 | Kanasugi et al. | |
| 2002/0015602 | A1* | 2/2002 | Mochimaru | G03G 15/232 399/309 |
| 2004/0085423 | A1 | 5/2004 | Bronstein et al. | |
| 2007/0058022 | A1 | 3/2007 | Yamanobe | |
| 2007/0176995 | A1 | 8/2007 | Kadomatsu et al. | |
| 2008/0166495 | A1 | 7/2008 | Maeno et al. | |
| 2009/0027473 | A1 | 1/2009 | Taniuchi et al. | |
| 2010/0073410 | A1* | 3/2010 | Yui | B41J 2/0057 347/6 |
| 2010/0073448 | A1* | 3/2010 | Ikuno | B41J 2/0057 347/102 |
| 2012/0013694 | A1 | 1/2012 | Kanke | |
| 2012/0038726 | A1* | 2/2012 | Pattekar | B41J 2/0057 347/103 |
| 2012/0105562 | A1 | 5/2012 | Sekiguchi et al. | |
| 2012/0127250 | A1 | 5/2012 | Kanasugi et al. | |

FOREIGN PATENT DOCUMENTS

| | | | |
|---|---|---|---|
| JP | 2007230232 | A | 9/2007 |
| JP | 2008018719 | A | 1/2008 |
| JP | 2008179136 | A | 8/2008 |
| JP | 2009051118 | A | 3/2009 |
| JP | 2009159330 | A | 7/2009 |
| JP | 2010030211 | A | 2/2010 |
| JP | 2011093198 | A | 5/2011 |
| JP | 2012020441 | A | 2/2012 |
| JP | 2012091342 | A | 5/2012 |
| JP | 2012096441 | A | 5/2012 |
| JP | 2012106445 | A | 6/2012 |

* cited by examiner

METHOD FOR THE INDIRECT APPLICATION OF PRINTING LIQUID ONTO A PRINTING MATERIAL

CROSS-REFERENCE TO RELATED APPLICATION

This is a divisional of patent application Ser. No. 14/570,479, filed Dec. 15, 2014, which was a continuation, under 35 U.S.C. § 120, of International Application No. PCT/EP2013/001750, filed Jun. 13, 2013, which designated the United States; this application also claims the priority, under 35 U.S.C. § 119, of the following German Patent Applications which are herewith incorporated by reference in their entirety:

DE 10 2012 011 783.3, filed Jun. 15, 2012;
DE 10 2012 011 781.7, filed Jun. 15, 2012;
DE 10 2012 011 780.9, filed Jun. 15, 2012;
DE 10 2012 011 782.5, filed Jun. 15, 2012;
DE 10 2012 014 409.1, filed Jul. 20, 2012;
DE 10 2012 019 953.8, filed Oct. 11, 2012;
DE 10 2012 021 983.0, filed Nov. 9, 2012;
DE 10 2012 021 984.9, filed Nov. 9, 2012;
DE 10 2012 023 389.2, filed Nov. 30, 2012;
DE 10 2012 024 393.6, filed Dec. 13, 2012; and
DE 10 2013 001 825.0, filed Feb. 4, 2013.

BACKGROUND OF THE INVENTION

Field of the Invention

The present invention relates to a method for the indirect application of printing liquid onto a printing material.

A wide variety of methods and apparatuses for what is known as indirect inkjet printing are known from the prior art. Here, a plurality of inkjet printing colors or inks are applied, that is to say jetted, onto a circulating intermediate carrier in a manner which corresponds to the printing image by means of inkjet print heads which are disposed one behind another. The printing inks or the multiple-color printing image are/is transferred from said intermediate carrier, for example a transfer belt or transfer cylinder, onto the substrate, for example a paper sheet or a paper web. The ink application therefore does not take place directly, but rather indirectly via the surface of a transfer apparatus onto the substrate. Said surface therefore has to be produced or treated in such a way that the necessary ink transfer is possible, that is to say it has to be capable of accepting the ink and delivering the ink again which has possibly been treated, for example has been cured.

U.S. Patent Application Publication No. 2008/0166495 A1 discloses, for example, a machine of this type for indirect inkjet printing. Said machine includes a central, circulating transfer belt as intermediate carrier for the inks which are jetted onto the belt by four print heads. Before the ink application, a coating liquid is applied onto the belt by means of a separate application apparatus. After the ink application, the ink is loaded on the belt with radiation from a radiation source and is cured in the process. Subsequently, the transmission of the inks or the printing image takes place in a heated press nip onto a substrate web, on which the ink is finally again thermally treated. The belt is cleaned by means of a cleaning apparatus before a renewed ink application.

U.S. Patent Application Publication No. 2007/0058022 A1 has disclosed a similar machine which, however, has a central transfer cylinder instead of a belt.

In the abovementioned apparatuses and methods of the prior art, there can be the problem that the printing ink is not detached without residue or substantially without residue from the intermediate carrier and transferred onto the printing material. Supplementary measures are therefore to be provided which assist the release of the printing ink. Measures of this type and also other measures are also already known from the prior art.

SUMMARY OF THE INVENTION

It is accordingly an object of the invention to provide a method for the indirect application of printing liquid onto a printing material which overcomes the hereinafore-mentioned disadvantages of the heretofore-known methods of this general type and makes it possible to detach printing liquid from an intermediate carrier without residue or at least virtually without residue and to transfer it from the said intermediate carrier onto a printing material.

According to the invention, this object is achieved by way of a method having the features recited in the following paragraph. Advantageous developments and other forms of said invention result from the associated further patent claims and from the following description and the associated drawings.

A method according to the invention for the indirect application of printing liquid onto a printing material, an intermediate carrier being provided, a liquid conditioning medium, including a first substance, being provided and being applied onto the intermediate carrier, a printing liquid, including a second substance, being provided and being applied onto the conditioning medium on the intermediate carrier, the printing liquid being situated as droplets or layer substantially on the conditioning medium, and the droplets or the layer forming a contact region on their underside with the conditioning medium, the printing liquid being heated, and the printing liquid being transferred from the intermediate carrier onto the printing material, is distinguished by the fact that the first substance of the liquid conditioning medium increases the viscosity of the printing liquid on the intermediate carrier in the contact region by way of a reaction with the second substance of the printing liquid and, as a result, the printing liquid forms a film in the contact region, and that the printing liquid has a lower viscosity outside the contact region than inside the contact region.

The provision of the features according to the invention can advantageously achieve a situation where, with the utilization of the film which is formed, the printing liquid can be detached without residue or at least virtually without residue from the intermediate carrier and can be transferred onto the printing medium. In particular, it is one advantage here that the viscosity of the entire printing liquid is not changed as a result of a reaction, but rather only the contact region of the printing liquid with the conditioning medium, and therefore only part of the droplets or a part layer of the layer of the printing liquid. The rest of the printing liquid which is situated outside the contact region in the droplets or the layer is not affected or is affected only insubstantially by the reaction and in the process maintains a lower viscosity. As a result, the printing liquid remains more fluid and possibly also tackier in this region and adhesion of the printing liquid to the printing material and therefore release of the printing liquid from the intermediate carrier is improved.

One development of the method according to the invention which is advantageous for the release of the printing liquid or the droplets or the layer including printing liquid from the intermediate carrier and is therefore preferred can be distinguished by the fact that the contact region has a layer thickness of less than 10 nanometers. In this way, a merely very thin film is formed on an outer face of the printing liquid and a considerable remainder of the printing liquid remains substantially in the state of the original viscosity. Even a thin film of this type can advantageously improve the release of the printing liquid from the intermediate carrier.

A further development of the method according to the invention which is advantageous with regard to the release of the printing liquid from the intermediate carrier and is therefore preferred can be distinguished by the fact that the viscosity is effected by way of curing of the printing liquid. As an alternative, the increase in the viscosity can also be effected by way of crystallization or jellifying of the printing liquid.

One development of the method according to the invention which is advantageous due to the simple provision and application and is therefore preferred can be distinguished by the fact that the conditioning liquid is applied as an aqueous solution. It can be provided here, in particular, that the liquid conditioning medium forms a layer with a thickness of approximately 1 micrometer, but at least less than approximately 5 micrometers. Even a thin aqueous layer of this type is sufficient to cause the reaction according to the invention and, as a result, to advantageously improve the release of the printing liquid from the intermediate carrier. In this way, a high printing quality can be achieved with low usage of consumable materials.

One development of the method according to the invention which is advantageous for curing of the printing liquid in the contact region and is therefore preferred can be distinguished by the fact that the printing liquid is applied as a liquid which contains polyacrylic. Here, it can be advantageous and therefore preferred to apply the liquid conditioning medium as a liquid which has polyvalent cations, in particular Ca(2+) or Al(2+). In this way, flocculation of the polyacrylic acid can be brought about and therefore a change in viscosity can be caused.

It is advantageous and therefore preferred due to the controllability of the change in viscosity, according to one development of the method according to the invention, to activate the first substance by way of radiation in order to react with the second substance. A first substance which can be activated by radiation advantageously allows both the reaction to be started at a given time and also the intensity of the reaction and therefore its result to be influenced by way of the radiation.

A printing press according to the invention is also to be considered within the context of the invention, which printing press is constructed, by way of the provision of corresponding components, to carry out the process steps of the abovementioned methods according to the invention and in the process to provide the necessary substances.

In the prior art, there can be the problem that the ink droplets do not spread, that is to say run, sufficiently on the intermediate carrier in order for it to be possible to form solid areas. In order for it to be possible to achieve sufficient spreading of this type of the printing liquid on the intermediate carrier, the surface energy of the intermediate carrier has to be set correspondingly.

Against this background, it is an object of the present invention to provide a method which is improved in comparison with the prior art and makes transfer of the printing liquid which is free of residue or at least virtually free of residue from the intermediate carrier onto the printing material possible.

According to the invention, this object is achieved by way of a method having the features recited in the following paragraph. Advantageous developments of this invention result from the associated subclaims and from the following description and the associated drawings.

A method according to the invention for the indirect application of printing liquid onto a printing material, an intermediate carrier being provided, a liquid release agent being provided and being applied onto the intermediate carrier, a printing liquid being provided and being applied onto the intermediate carrier, the printing liquid being heated, and the printing liquid being transferred from the intermediate carrier onto the printing material, is distinguished by the fact that the release agent has a boiling temperature which is higher than the boiling temperature of the solvent of the printing liquid.

The achievement according to the invention of the object advantageously allows the printing liquid to be transferred without residue or at least virtually without residue from the intermediate carrier onto the printing material. To this end, the printing liquid is heated. Said heating can be effected, for example, by way of loading with hot air or with infrared radiation. Since the printing liquid is situated above the release agent on the intermediate carrier, the heating of the printing liquid will also as a rule lead to heating of the release agent. It has been recognized within the context of the invention that the provision of a release agent boiling temperature which is higher than the boiling temperature of the solvent of the printing liquid is advantageous. A correspondingly high boiling temperature of the release agent allows solvent to evaporate from the printing liquid without at the same time causing evaporation of the release agent. According to the invention and advantageously, it can be ensured in this way that the release agent is retained below the printing liquid, preferably as a release layer, and can develop its release action during the transfer of the printing liquid from the intermediate carrier onto the printing material.

One development of the method according to the invention which is advantageous with regard to the media used and is therefore preferred can be distinguished by the fact that the release agent includes alcohol, in particular glycol or glycerin or glycol ether. As a result of the provision of the stated substances, the boiling temperature can be set to a value which is higher than the boiling temperature of the solvent of the printing liquid. In addition to the stated substances, comparable organic liquids with an intermediatory effect between oleophilic and hydrophilic liquids can also be used.

A further development of the method according to the invention which is advantageous with regard to the media used and is therefore preferred can be distinguished by the fact that the release agent includes an aqueous gel. As an alternative to this, the release agent can also include a non-aqueous gel. It is preferably provided in both cases that the release agent also includes a thickening agent. For example, pectin, agar agar or cellulose can be provided as a thickening agent of this type.

One development of the method according to the invention which is preferred due to its particularly advantageous release action can be distinguished by the fact that the release agent is applied onto the intermediate carrier as a release layer, in particular as a release layer with a thickness between approximately 1 μm and approximately 10 μm.

One development of the method according to the invention which is likewise preferred due to its advantageous release effect can be distinguished by the fact that the release agent wets the surface of the intermediate carrier substantially completely. Furthermore, it can advantageously be provided that the printing liquid spreads sufficiently on the release layer, with the result that the printing liquid of the individual printer dots of a defined printing color can run together on the release layer to form a solid area if this is desired. To this end, it can be necessary, furthermore, to apply the printer dots onto the intermediate carrier sufficiently closely to one another and with a sufficient printing liquid quantity.

A further advantageous and therefore preferred development of the method according to the invention with an advantageous release action can be distinguished by the fact that the transfer of the printing liquid onto the printing material is effected by way of splitting of the release layer. As a result of said splitting within the release layer, the printing liquid is transferred completely or at least virtually completely from the intermediate carrier onto the printing material. Here, the release layer itself can be transferred partially. Residues of the release layer on the intermediate carrier can be removed by way of cleaning and/or can be supplemented by way of new release agent to form a new complete release layer.

A further development of the method according to the invention which is advantageous with regard to a satisfactory print quality which can be achieved and is therefore preferred can be distinguished by the fact that a further layer of a further liquid is applied onto the release layer, the further liquid influencing the spreading behavior of the printing liquid on the release layer. As has already been mentioned above, it can be necessary when printing solid areas to use measures such that the applied printing liquid or the individual printer dots run into one another. To this end, the spreading behavior of the printing liquid on the release layer has to be set correspondingly. This setting can be achieved by way of the provision of a further layer on the release layer. Here, the spreading behavior of the printing liquid on the release layer can be effected, in particular, by way of adapting of the surface energies of the media used to one another. If the release layer itself or the further layer which is applied onto the release layer has a sufficiently high surface energy, the printer dots of printing liquid which are set are formed with sharp edges, whereas running of the printer dots into one another can be achieved in the case of a sufficiently low surface energy.

One development of the method according to the invention which is advantageous with regard to the application process and is therefore preferred can be distinguished by the fact that the printing liquid is a printing ink and is applied onto the intermediate carrier using the inkjet process and/or that the release agent is applied onto the intermediate carrier using the inkjet process. If both media are applied using the inkjet process, it is advantageously possible, furthermore, to apply the release agent only in those regions, in which printing ink has also been applied. In other words: in this case, the release agent can also be applied in a manner which corresponds to the printing image and a considerable quantity of release agent can be saved in the process, in particular in those cases, in which large regions in the printing image represent non-image points.

One development of the method according to the invention which is advantageous for setting the boiling temperature of the release agent and is therefore preferred can be distinguished by the fact that the printing liquid includes a substance, in particular a solvent or an additive, which passes into the release layer and increases the boiling temperature of the mixture of release agent and substance above the boiling temperature of the printing liquid. The penetration of the substance into the release layer can take place, for example, by way of diffusion. In the imaged regions, that is to say in those regions, in which printing liquid comes to lie on the release agent, a mixture or solution including the substance of the printing liquid and the release agent is therefore produced and, as a result of said mixing or dissolving, the boiling temperature of the mixed or dissolved release layer which is produced in the process is increased in comparison with the originally applied release layer, according to the invention above the boiling temperature of the solvent of the printing liquid.

Finally, one development of the method according to the invention which is advantageous with regard to the media used and is therefore preferred can be distinguished by the fact that the release agent is water and that the substance is a solvent of the printing liquid which is different from water. The solvent of the printing liquid which is different from water is expelled during heating of the printing liquid and is mixed with the release agent of the originally applied release layer. According to the invention, the mixture which is formed in this way in turn has a higher boiling point than the water. This solution according to the invention has the advantage that the applied release layer including water is retained after heating only in the regions, in which printing liquid has also been applied onto the release layer.

A printing press can also be considered to be within the context of the invention, which printing press is made capable of carrying out the abovementioned methods according to the invention by way of the provision of corresponding components and by way of the provision of a corresponding controller.

In the known devices which operate according to the indirect inkjet printing process, the intermediate carrier as a rule has an outer layer of plastic, rubber or silicone rubber or similar materials, which outer layer is intended to make complete transfer possible of the printing liquid which is jetted onto the surface and is subsequently dried or solidified on the intermediate carrier onto the printing material. Said materials have a comparatively poor thermal conductivity. There is possibly also a foam rubber layer below said layer, which foam rubber layer is intended to improve the compression behavior of the intermediate carrier and in practice acts thermally as an insulation layer. In the case of indirect inkjet printing with water-based printing inks, the required energy for evaporating the water of the ink is therefore as a rule supplied from the outside by way of radiation and hot air, as is also described, for example, in U.S. Pat. No. 7,997,717 B2.

In a rubber layer, however, temperature differences are also not equalized or are equalized only very slowly in the lateral direction, that is to say in the plane of the surface of the intermediate carrier. If printing images with relatively great ink coverage are then printed, the following problem occurs, in particular, when water-based inks are used: due to the evaporation of the water from the printing liquid, the surface of the intermediate carrier is cooled to a considerably greater extent in the regions with great ink coverage than in regions with low ink coverage. In this way, a thermal image is as it were written onto the surface of the intermediate carrier, which thermal image can influence the properties of the belt in relation to ink acceptance or uniform acceptance of release agent, the properties of the inkjet nozzles which are situated only at a very small spacing above the belt, but also the transfer properties of the belt during the transfer of the printing image onto the printing material. Furthermore, it is difficult in the case of print jobs with high ink coverage to couple the entire required energy into the ink, in order to evaporate the water component. If the quantity of energy is not sufficient, the ink in the printer dots is not sufficiently dry enough, in order to be transferred completely from the intermediate carrier onto the substrate. Since the methods of indirect inkjet printing are based, however, on the fact that the printing image or the solidified ink droplets pass completely from the intermediate carrier onto the printing substrate during each revolution of the intermediate carrier, even small residues which remain on the intermediate carrier are not acceptable, since they disrupt the following image and cause spoilage. Secondly, points of the intermediate carrier which are not covered with printing liquid are heated unnecessarily, which not only means a waste of energy, but rather also that the inkjet heads are greatly loaded thermally, as will also be described in the following text.

For methods of direct inkjet printing, in which the ink is applied directly onto a printing substrate, it is known to dry the printing image on, for example, the paper directly after its production with the aid of laser radiation which is applied in a spatially resolved manner, by only the printed regions being irradiated by the laser. Methods of this type are described, for example, in European Patent EP 993378 B1, U.S. Pat. No. 6,857,734 B2 and U.S. Patent Application Publication No. 2004/085423 A1. In most cases, the method is used in conjunction with what are known as UV inks which are cured by way of ultraviolet radiation. In methods of this type, the abovementioned problem of cooling of an intermediate carrier surface in the image regions does not occur, since firstly there is no intermediate carrier at all and secondly said inks are not water-based. In so far as reference is made to what are known as "infrared curable inks" U.S. Patent Application Publication No. US 2004/0085423 A1, in said document they are inks which are cured by way of crosslinking of acrylic resins, but are not water-based inks, in which high quantities of energy are required, in order to evaporate the water which is contained in the ink.

It is therefore the object of the present invention to specify a method and to provide a device for indirect inkjet printing with water-based inks, by way of which the abovementioned disruptive influences are avoided or are at least reduced.

According to the invention, this object is achieved by way of a method and a device having the features recited in the following paragraph. Advantageous developments result from the respectively associated subclaims and the following description and from the figures of the appended drawings.

The method according to the invention is distinguished by the fact that the intermediate carrier is heated by way of radiation locally only at the image points before the ink is jetted on and/or directly upstream of the press nip.

The method according to the invention leads to the negative effect described above at the outset of "thermal images" which are written into the intermediate carrier surface being avoided. This can expediently be achieved firstly by a positive thermal image being written into the intermediate carrier surface upstream of the inkjet heads in the movement direction of the intermediate carrier, for example by means of a correspondingly controlled infrared laser diode array, on which positive thermal image the droplets begin to evaporate after being jetted on, and optionally a water-based conditioner which was also applied upstream of the inkjet heads also evaporates. During the evaporation operation, the inscribed positive thermal image then cools down and assumes approximately the same temperature as the non-image points, onto which no ink is jetted. This also has the advantage that surface regions of the belt with a comparatively low temperature lie opposite those nozzles of the inkjet heads in the non-image points which are situated directly above the intermediate carrier and are used far more rarely than the nozzles in the image points. In this way, the risk of what is known as "clocking", that is to say clogging of inkjet nozzles which are not currently required, is reduced, a risk which increases as the temperature rises.

By way of the method which is described, the intermediate carrier, for example a belt or coated or covered cylinder, can therefore be heated in a targeted manner precisely at the point, at which an image point is to be applied. This has the advantage that the intermediate carrier is supplied with energy only where it is actually also required, that is to say is actually loaded with ink which requires energy to evaporate. In this way, energy is saved and the thermal influencing of the print heads at those points of the nozzles which do not print is reduced. However, the method is also suitable for pinning, curing, surface drying or completely drying conditioner liquids, primers or functional coatings which are applied onto the intermediate carrier before the ink is printed on, to be precise exactly at the image points where this is required, namely where the ink is subsequently jetted on.

Secondly, the object which was set at the outset can also be achieved, however, by virtue of the fact that the printing image which has already been solidified and has cooled considerably in comparison with the surrounding non-image points during the evaporation of the water in the ink before the transfer from the intermediate carrier onto the printing substrate is heated with radiation energy in a targeted manner only at the image points.

In this way, the negative thermal image which has already been written into the belt surface as a result of evaporation of the solvent or water of the ink is also raised to the temperature level of the surrounding non-image points via the radiation which is applied additionally only at these points. There is also another positive effect on the transfer behavior from the intermediate carrier to the printing substrate, namely that the solidified ink of the image points is heated into a desired temperature range which is optimum for the transfer of the ink image from the intermediate carrier onto, for example, the paper.

In this way, the viscosity or the phase of the printer dots to be transferred can be set before they are transferred onto the printing material in the press nip. It can be expedient here to place the device, which radiates the intermediate carrier in a manner which is dependent on the image upstream of the press nip, in accordance with the speed of movement of the intermediate carrier in such a way that a defined finite time is maintained between the radiation and the entry into the press nip which is, for example, typical for a glass transition for the polymer, of which the printing liquid ultimately consists in the evaporated state. If the polymer is then melted exactly during the entry into the press nip, doubling effects are prevented, induced, for example, as a result of paper sheets which come into contact upstream of the press nip.

In order for it to be possible to utilize the full scope of the advantages of the method, it can be necessary to construct the printing liquids and/or the coatings of the intermediate carrier to be sufficiently light-absorbing. If operation is carried out in a targeted manner with IR radiation upstream of the press nip, absorber substances which absorb radiation in the infrared or near-infrared can be added to the printing liquids. However, it can also be sufficient to provide the surface of the intermediate carrier in itself with the required absorbency in the infrared or near-infrared. In this case, for example, infrared radiation penetrates through the polymer particles which are already solidified and of which the printing liquid still consists after its water component has been evaporated, and heats the surface of the intermediate carrier which lies underneath. In this way, absorbing additives in the printing liquids or inks can be dispensed with.

It is particularly advantageous to combine both measures with one another, that is to say firstly to already impart a positive thermal image into the surface of the intermediate carrier before the latter reaches the inkjet heads, and additionally to neutralize the negative thermal image by way of radiation upstream of the press nip, which negative thermal image is produced during the evaporation of the water constituent part of the ink, or to heat up the solidified printing liquid there.

Furthermore, it can be expedient to cool down the intermediate carrier in the region between the press nip, that is to say after the transfer of the ink image onto the printing substrate and before the application of a new image onto the intermediate carrier, in order then to set temperatures for the intermediate carrier which are not too high and can be controlled in the following region below the print heads. If a belt is used as intermediate carrier, this can be achieved, for example, by way of cooled deflection rolls, over which the intermediate carrier or the intermediate carrier belt is guided with a large wraparound angle. The primary issue here is that the cylinder which makes contact with the surface of the intermediate carrier belt consists of highly thermally conducting material, such as a metal, thermally conducting ceramic or thermally conducting plastic, and is cooled.

For the case where the intermediate carrier consists of a cylinder, the cylinder surface of the intermediate carrier is expediently brought into contact with a cooled or temperature-controlled highly thermally conducting belt, for example a metal belt. In this way, very large quantities of heat can effectively be dissipated from the outer layer of the intermediate carrier as a result of the full-surface contact.

Various radiation sources are suitable for carrying out the method according to the invention. Firstly, diodes which emit light in the infrared can be used which can also be obtained as diode arrays with sufficient resolution, in order to heat only the image points on the intermediate carrier. However, it is also possible to use lasers, for example pulsed lasers, for this purpose, which are operated in the scanning mode, that is to say scan the intermediate carrier transversely with respect to the process direction and are switched on only where an image point is also situated. Furthermore, edge-emitter diode laser arrays or VCSEL arrays can be used, or lasers which are coupled to fiber bundles, in which the coupling is enabled only for the fibers, the end of which is aimed at an image point.

Against the background of the prior art, it is an object of the present invention to provide a method for the indirect application of printing liquid onto a printing material, which method is improved in comparison with the prior art of indirect inkjet printing and makes it possible to transfer printing liquid without residue or at least virtually without residue from an intermediate carrier onto the printing material. Moreover, it is a further object of the present invention to provide a device for the indirect application of printing liquid onto a printing material, which device is improved in comparison with the prior art of what is known as indirect inkjet printing and displays corresponding advantages.

According to the invention, these objects are achieved by way of a method and a device having the features recited in the following paragraph. Advantageous developments of said inventions result from the respectively associated subclaims and from the following description and from FIG. 1.

A method according to the invention for the indirect application of printing liquid onto a printing material, an intermediate carrier being provided, a liquid release agent being provided and being applied onto the intermediate carrier, a printing liquid being provided and being applied onto the intermediate carrier only at the printing points in a manner which corresponds to a printing image, the printing liquid being heated, and the printing liquid being transferred from the intermediate carrier onto the printing material, is distinguished by the fact that the intermediate carrier is provided with a metallic coating, and that the release agent is applied as a molecular coat onto the metallic coating.

The method according to the invention advantageously allows what is known as indirect inkjet printing, it being possible to ensure a residue-free or at least virtually residue-free transfer of printing liquid from the intermediate carrier onto the printing material. To this end, according to the invention, the intermediate carrier is provided with a metallic coating and a molecular coat is applied onto said metallic coating. Here, said molecular coat is configured in such a way that the molecules develop an adhesive action which allows the printing liquid to adhere to the molecularly coated surface of the intermediate carrier. At the same time, however, the molecular coat is also configured in such a way that the printing liquid which then adheres to the intermediate carrier can be released again from the surface of the intermediate carrier in a press nip and can be transferred onto the printing material. This can be achieved, for example, by virtue of the fact that the adhesive action of the printing ink on the surface of the printing material in the press nip exceeds the adhesive effect of the molecular coat and, as a result, the printing liquid or the printing layer which is formed by it is released from the surface of the intermediate carrier. In the case of a water-based printing liquid, this can be achieved, for example, by way of molecules which hydrophilize the surface of the intermediate carrier, with the result that said surface accepts the water-based printing liquid and allows it to adhere. This applies correspondingly to oil-based printing inks. Since, however, the printing liquid still has a certain tackiness on its surface and is pressed onto the surface of the printing material in the press nip, the forces which act as a result on the printing liquid exceed the forces which are imparted by way of the hydrophilicity or hydrophobicity/oleophilicity of the molecules on the printing liquid, and said printing liquid or the layer which is formed by it is transferred without residue or at least virtually without residue from the surface of the intermediate carrier onto the surface of the printing material.

One development of the method according to the invention which is advantageous with regard to the media used and is therefore preferred can be distinguished by the fact that the molecular coat includes an amphiphilic organic compound. Here, molecular coats containing phosphonic acid or hydroxamic acid are particularly preferred.

A device according to the invention for the indirect application of printing liquid onto a printing material having an intermediate carrier, a first application apparatus which applies a liquid release agent onto the intermediate carrier, a second application apparatus which applies a printing liquid onto the intermediate carrier only at the printing points in a manner which corresponds to a printing image, a heating device which heats the printing liquid, and a press nip, in which the printing liquid is transferred from the intermediate carrier onto the printing material, is distinguished by the fact that the intermediate carrier has a metallic coating, and that the release agent is applied as a molecular coat onto the metallic coating.

The device according to the invention is accompanied by advantages, as have already been described above in relation to the method according to the invention. Here, according to the invention, a liquid release agent is applied by way of the first application apparatus, the release agent being applied as a molecular coat onto the metallic coating. The applied molecular coat on the metallic coating of the intermediate carrier in turn ensures that the printing liquid on the surface of the intermediate carrier adheres to the intermediate carrier from the point of the application of the printing liquid as far as the point of the transfer of the printing liquid onto the printing material in a press nip. At the same time, the molecular coat ensures that the printing liquid can be released completely or at least virtually completely from the surface of the intermediate carrier in the press nip and can be transferred onto the surface of the printing material.

One development of the device according to the invention which is advantageous with regard to the construction of the device for indirect inkjet printing with a plurality of print heads which are disposed one after another and is therefore preferred can be distinguished by the fact that the metallic coating is applied on a flexible carrier belt of the intermediate carrier. Said carrier belt can be guided around cylinders and the plurality of print heads for indirect inkjet printing can be disposed adjacently with respect to one run of the carrier belt.

One development of the apparatus according to the invention which is advantageous for taking up the molecular coat and is therefore preferred can be distinguished by the fact that the metallic coating and its surface are oxidized. It is particularly preferred that the metallic coating includes oxidized titanium, oxidized stainless steel, oxidized aluminum, titanate or zirconate.

One development of the device according to the invention which is advantageous for the thermal treatment of the printing liquid on the intermediate carrier and is therefore preferred can be distinguished by the fact that the intermediate carrier includes an absorption layer and/or a buffer layer and/or a thermal insulation layer. Here, the absorption layer can be configured in such a way that it absorbs irradiated infrared or else near-infrared radiation in a particularly satisfactory manner and, as a result, makes heating of the intermediate carrier possible, with the result that the generated heat can be utilized to heat up the printing liquid and dry the printing liquid. To this end, the absorption layer can include absorption centers or absorbers which are adjusted to the wavelength of the irradiated infrared radiation. If the absorption layer does not itself have a sufficient buffer action for the thermal energy which is coupled in, it can be advantageous to provide a buffer layer which is separate from the absorption layer below the absorption layer, which buffer layer is constructed to briefly buffer store the thermal energy which is coupled in, due to a thermal capacity which is selected to be sufficiently high. At the same time, said buffer layer and also a thermal insulation layer which is possibly situated underneath should be configured with regard to their thermal conductivity in such a way that a heat flux in the lateral direction and downward into the intermediate carrier is prevented effectively. In other words: the thermal energy which is coupled in is to be maintained as far as possible at the points of the intermediate carrier, at which it was coupled in directly. In this way, it becomes possible namely to digitally dry the printing liquid on the intermediate carrier by way of a digitally controllable dryer, that is to say drying using the data of the printing image. Here, thermal energy is coupled in only at the points, at which there is also printing liquid on the intermediate carrier. It can therefore be advantageous to prevent a heat flux in the lateral direction. The prevention of the heat flux into the intermediate carrier should be prevented, since, as a result, heat radiation sources can be selected which have a lower power output.

In particular in the case of pronounced ink coverage of the intermediate carrier with aqueous printing inks, it can become difficult to apply the required thermal energy to the intermediate carrier for evaporating the water component of the printing ink. It proves advantageous here if the metallic intermediate carrier or the metallic coating contains ferromagnetic material. This is because it is then possible to heat the intermediate carrier close to its surface by way of magnetic induction and in this way to effectively couple very high quantities of energy into the intermediate carrier.

One development of the device according to the invention which is advantageous with regard to the media used and is therefore preferred can be distinguished by the fact that the molecular coat includes an amphiphilic organic compound. A molecular coat containing phosphonic acid or hydroxamic acid is particularly preferred here.

One development of the device according to the invention which is advantageous for indirect inkjet printing and is therefore preferred is distinguished finally by the fact that the second application apparatus for the printing liquid is configured as an inkjet head. Accordingly, a plurality of print heads are provided during printing of multiple-color images.

It is an object of the present invention to specify a method, by way of which remaining disruptive ink residues on the surface of an intermediate carrier in the case of indirect inkjet printing can be removed in a way which is as gentle as possible without excessive expenditure.

This object is achieved by way of the features recited in the following paragraph.

According to the invention, mechanical loading of the surface of the intermediate carrier which goes beyond what the intermediate carrier experiences anyway during the transfer of the inkjet image which is buffer-stored on it onto the printing substrate is avoided. Instead, after contamination is detected or at regular intervals, it is subjected to a cleaning procedure, in which remaining parts of the ink are printed onto a surface which is provided specifically for this purpose. This can be a surface, on which those parts of the image which have already solidified adhere better than on the surface of the printing material which is currently being used. However, this can also take place by virtue of the fact that its adhesion is improved further with respect to the printing material by the non-transferred parts of the inks being covered once more with ink and then being printed together with the non-transferred parts of the ink onto the surface which is provided for this purpose. The latter surface can expediently be formed by a printing substrate itself, to which the remaining points, which have a very small area, in particular, of the non-transferred solidified ink adhere after all once they have been covered over a great surface area. In the first case, a printing substrate can be expediently used with somewhat different surface properties than the printing material which is used for the print job, that is to say, for example, a specific "cleaning sheet" made from paper with a coated surface or in the form of a plastic film instead of the uncoated paper which is used for the print job. A cleaning sheet of this type can be inserted, for example, at regular intervals or if required into the transport path for the printing material, then removes the solidified ink residues from the intermediate carrier while passing through the press nip due to its high affinity with respect to said solidified ink residues, and is subsequently ejected again from the paper transport as a spoilage sheet.

However, it is also possible to realize the surface which is provided for printing the non-transferred parts of the ink by way of a paper or plastic reel which can be thrown on or a cleaning roll which makes contact with the intermediate carrier at the same surface or circumferential speed as the surface of said intermediate carrier itself and which removes residual ink which is transferred onto it, in order then to be cleaned itself, which in turn is possible without problems, since its surface can be configured to be sufficiently resistant with respect to a cleaning operation.

For example, the surface which is provided for printing the ink residues can be formed by the outer face of the impression cylinder, by which the printing substrate is normally brought into contact with the surface of the intermediate carrier, but expediently also in a form which is modified in such a way that the impression cylinder has a cover which is clamped onto it, can preferably be pre-rinsed and then for its part absorbs the residual ink, for the purpose of the removal of residual ink from the intermediate carrier.

For the case where remaining ink residues are covered once more with applied ink during the cleaning procedure, it is expedient to perform the covering only in the image regions, in which the ink application has actually taken place incompletely onto the printing substrate. In order to detect this, the surface of the intermediate carrier is scanned electronically by an image sensor after the image transfer onto the printing substrate and is subjected to image processing, with the aid of which the extent and position of the contamination of the surface of the intermediate carrier is detected. However, it is also possible to cover the full area of the contaminated regions of the intermediate carrier, which then does not necessarily have to take place by way of the inkjet heads of the device for indirect inkjet printing, but rather can also take place by way of full surface-area spraying by means of a few spray nozzles or by way of full surface-area application by means of rolls.

The covering of the ink residues can in principle take place with the same ink, with which the inkjet image is printed onto the intermediate carrier. When the covering of the ink residues is not carried out by way of the inkjet heads themselves, but rather by a different device such as spray nozzles or application rolls, a fluid is then expediently used, however, which improves the transfer behavior during printing and possibly operates according to a different solidification mechanism than the ink which is used to generate the inkjet image. For the cleaning procedure, a fluid can therefore expediently also be sprayed onto the non-transferred ink residues, which fluid contains radiation-curing constituent parts and is irradiated with UV radiation during the cleaning procedure. In this way, a solidified film is then formed on the intermediate carrier surface, which solidified film "carries away" the ink residues which adhere to the film underneath and transfers them in the press nip onto a cleaning sheet.

In the case of indirect inkjet printing with water-based printing inks, the required energy for evaporating the water of the ink is as a rule supplied by way of radiation and hot air from the outside, as is also described, for example, in U.S. Pat. No. 7,997,717 B2. In said device, although an additional heating roll is provided in the interior of the intermediate carrier cylinder, in order to input further thermal energy into the intermediate carrier, it rolls in linear contact on the interior of the intermediate carrier. It is not suitable at this point to homogenize temperature differences on the surface of the intermediate carrier and, in addition, the energy transfer onto the intermediate carrier is poor due to the linear contact. It is therefore the object of the present invention to specify a method and to provide a device, by way of which the abovementioned disruptive influences are avoided or are at least reduced.

According to the invention, this object is achieved by way of a method and a device having the features recited in the following paragraph. Advantageous developments result from the respectively associated subclaims and the following description and from the figures of the appended drawings.

The method according to the invention is distinguished by the fact that thermal energy is applied or input or is dissipated onto or into the outer layer of the intermediate carrier as a result of direct contact with a surface with a high thermal conductivity and/or the thermal energy which has already been applied to the layer or input into it is homogenized over the surface of the intermediate carrier.

The method according to the invention eliminates the above-described negative effect of inscribed "thermal images" in the intermediate carrier surface as a result of the contact of the outer intermediate carrier layer with materials of satisfactory thermal conductivity. This is expediently achieved, for example, by virtue of the fact that the intermediate carrier surface is in direct contact or is brought into direct contact with rolls or belts of satisfactorily thermally conducting materials made from metal such as copper, aluminum, stainless steel, nickel or else thermally conducting ceramics such as $Al_2O_3$ or aluminum nitride, after the printing image has been transferred onto the substrate to be printed. Since the direct inkjet printing method after all operates with complete transfer of the printing ink onto the printing substrate, the surface of the intermediate carrier is free of ink at this point and can therefore be brought satisfactorily into contact with metal cylinders or a metal belt, without disruptive influences again being exerted on the sensitive surface of the intermediate carrier as a result of this contact itself. In this way, temperature differences in the surface of the intermediate carrier are homogenized, with the result that disruptive thermal inhomogeneities are eliminated, before the intermediate carrier is newly coated or imaged by the inkjet heads.

When the intermediate carrier consists of a belt, it is expedient to provide at least one metal cylinder, over which the intermediate carrier belt is guided with a great wrap-around angle, the primary issue here being that the cylinder which makes contact with the surface of the intermediate carrier belt is heated and/or consists of satisfactorily thermally conducting material such as a metal, thermally conducting ceramic or thermally conducting plastic. In order to assist or to increase the temperature of the temperature input into the intermediate carrier, it can be expedient, however, to also heat the remaining cylinders, rollers or rolls which are wrapped around and with which the underside of the intermediate carrier belt comes into contact.

For the case where the intermediate carrier consists of a cylinder, the cylinder surface of the intermediate carrier is expediently brought into contact with a heated or temperature-controlled satisfactorily thermally conducting belt, for example a metal belt. In this way, very large heat quantities can be input into the outer layer of the intermediate carrier effectively by way of the full surface-area contact, and the temperature differences which already exist of the intermediate carrier surface can be homogenized.

A further possibility for reducing or eliminating the above-described thermal effects on the surface of the intermediate carrier consists in constructing the intermediate carrier in itself to have multiple layers in such a way that a metal layer directly follows under a relatively thin, outer layer which is optimized in relation to ink acceptance and transfer behavior. Said metal layer then brings about the lateral homogenization of the temperature differences in the plastic, rubber or silicone rubber layer which lies above, conducts the temperature relatively poorly, and in which a temperature equalization would otherwise take place only very slowly.

Thermal energy for heating the intermediate carrier can also be input directly via a metallic contact into the outer layer in this variant of the invention. This is because, if the metal layer which lies underneath has ferromagnetic properties, it can be provided very effectively with thermal energy in a contactless manner, to be precise at any desired points by way of induction heating apparatuses which are disposed there.

In the above text, the invention has been described in a device for indirect inkjet printing. However, it can likewise be used in a printing device which operates electrophotographically and operates with an intermediate carrier, onto which the electrophotographically generated toner image is printed before it is printed over onto the actual printing substrate. In particular, the invention can also be used precisely in printing devices of the type which operate with liquid toner; the actual toner is therefore dispersed in an oil or hydrocarbon mixture (Isopar).

If printing is carried out with water-based inks in the indirect inkjet printing method, considerable quantities of water are to be evaporated within a short time, in order to dry the printing liquid to such an extent that the non-evaporated residue can be transferred in the press nip onto the printing substrate or the paper. As a rule, it is a polymer which carries the colorant or the pigments which are dispersed therein or adhere thereto. Said quantities of energy are fed in by way of heat, infrared radiation, etc. and greatly heat up the surface of the intermediate carrier. In contrast, the inkjet head or its nozzle openings is/are only at a very small spacing of typically 1 mm from the surface of the "hot" intermediate carrier. This leads to the ink in the nozzles which do not continuously eject ink becoming highly viscous because the water evaporates and clogs the nozzles. Ink then has to be continuously ejected through the nozzles correspondingly often by way of additional so-called "purging" of ink into print-free regions, in order to keep the nozzles free, which increases the ink consumption. An attempt is made to "blow clogged nozzles open" by way of a pressure increase, since otherwise the inkjet head is blocked, that is to say the nozzles remain closed irreversibly, which results in an expensive replacement of the heads.

An attempt might now be made to deal with the above-mentioned problem, by the inkjet heads being shielded thermally from the intermediate carrier or being cooled or temperature-controlled, in order to keep them in the range of temperatures below 40° C. which are customary for aqueous inkjet printing. However, this cannot be realized simply, in particular due to the very small spacing between the heads and the intermediate carrier and, if at all possible, would be possible only with a very high use of device technology. Moreover, additional problems would then be created, since the moisture of the evaporating water component from the ink then condenses on the cooled inkjet head, impairs the jet behavior of the nozzles or causes water stains in the inkjet image.

It is therefore the object of the present invention to specify a method, in particular for indirect inkjet printing with water-based printing liquids, by way of which the above-described problems can be avoided or at least reduced, by, for example, the time between the "purging" sequences being extended considerably and the risk of irreversible blockage of the inkjet heads being reduced considerably.

According to the invention, this object is achieved by way of a method and a printing liquid or ink which is suitable for this purpose as specified in the following paragraph. Advantageous developments of said invention result from the associated subclaims and from the following description and the associated drawings.

According to the invention, a quite different approach is therefore used and, instead, the inkjet head or the inkjet heads is/are operated at temperatures above 70° and the printing liquid is adapted to said temperature range by solvents which boil above 120° being added to it. Water-soluble solvents of this type are expediently selected from the following compounds: alkylic alcohols, glycol or oligomers thereof, alkylic single or multiple glycol ethers, cyclic ethers, dioxolanes, pyrrolidones or mixtures thereof. Ethyl glycol, diethylene glycol, propylene glycol, dipropylene glycol and methoxy or ethoxy derivatives thereof, diglymes, 1-alkanols, 2-alkanols, 1,n-alkane diols, polyols of the type HOCH2 [CH(OH)]nCH2OH where n<4, glycerine and glycerine formal are very particularly suitable for this purpose.

It is of course also possible to mix a plurality of different substances and substance classes mentioned with water; it can be expedient if individual constituent parts of said aqueous solvent mixture can form azeotropic mixtures, to be precise advantageously mixtures which are associated with an increase in the boiling temperature.

This all contributes to protecting the inkjet head or its nozzles which is/are operated at the stated high temperature against blockage, and to extend the times between the purging sequences considerably.

Other features which are considered as characteristic for the invention are set forth in the appended claims.

Although the invention is illustrated and described herein as embodied in method for the indirect application of printing liquid onto a printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
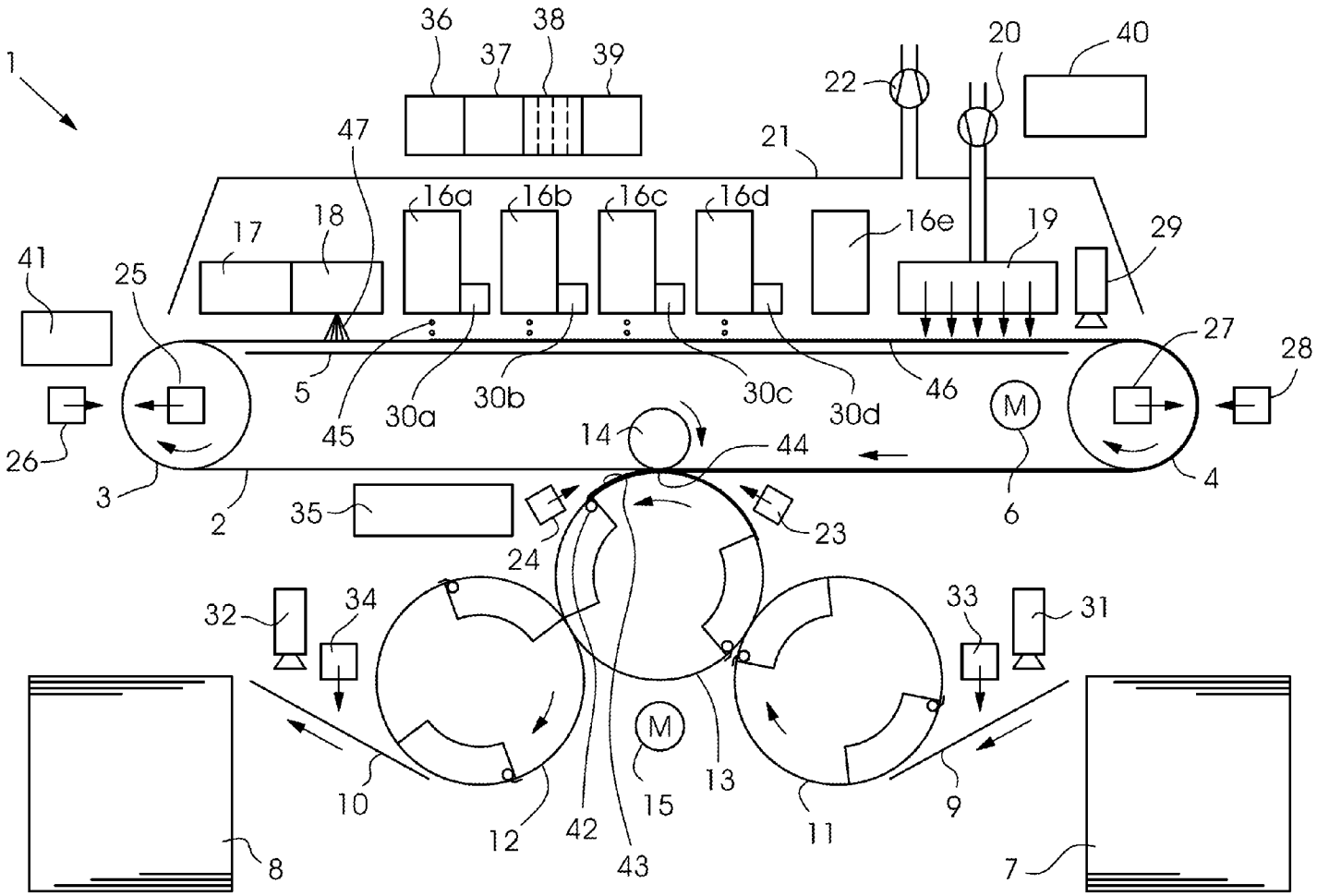
FIG. 1 shows a diagrammatic view of one preferred exemplary embodiment of a device according to the invention and the process steps according to the invention which can be carried out by said device according to the exemplary embodiments of the method according to the invention.

The device 1 in FIG. 1 includes a circulating belt 2 which is guided around two cylinders 3 and 4 and over a guide face 5. At least one of the two cylinders is driven by a motor 6 and for its part drives the belt. The guide face serves to stabilize the run of the belt in the region of the print job.

The printing material is transported in the form of individual sheets from a feed stack 7 to a delivery stack 8. The transport takes place via sheet guides which are shown in simplified form as lines 9 and 10 (they can actually be one or more transport cylinders) and by means of the sheet transport cylinders 11, 12 and 13. The latter have gripper systems 42 for the printing material sheets 43. Each individual sheet 43 runs through a press nip 44 between the cylinder 13 and a press roll 14 which is set against the former. Said sheet transport system is driven via at least one motor 15.

Adjacently with respect to the run of the belt 2, a plurality of print heads 16*a* to 16*d* are disposed so as to follow one another, for example print heads for the customary colors cyan, magenta, yellow and black. Each print head generates ink droplets 45 which are jetted onto the belt and generate ink dots there. In this way, multiple-color, halftone printing images can be generated. However, it can also be provided that the ink droplets of one color run into one another at least at some points and therefore form closed color areas. Since the print heads are disposed so as to follow one another in the running direction of the belt, the different ink dots also come to lie on one another partly. It can be provided that an apparatus 16*e* for print aftertreatment, for example for varnishing or for varnish application, is disposed downstream of the print heads 16*a* to 16*d*.

An apparatus 17 for belt treatment, for example for plasma treatment, is likewise disposed adjacently with respect to the belt 2. By means of the plasma or else a corona discharge, the belt surface can be cleaned and can be set into a starting state which is defined for application of liquid media with regard to the surface energy. Furthermore, an apparatus 18 for the application of conditioner is provided adjacently with respect to the belt 2. The conditioner ensures that the belt surface accepts the printing ink, that the printing ink does not undesirably spread or drip off on the belt, that the printing ink adheres to the belt during the belt transport, and that the printing ink can be transferred onto the printing material 44 in the press nip 44.

The printing ink 46 which is applied onto the belt 2 is dried at least partially by way of a hot air jet of a hot air dryer 19, by water and/or solvent being evaporated from the printing ink. The hot air is fed in via a feed 20 and the vapor which is produced by way of the drying is discharged via an air extraction means 22 which is integrated into a housing 21.

For further treatment, a further dryer 23, preferably an infrared dryer, is provided which heats the printing ink, the conditioner 47 and/or the belt 2 immediately upstream of and/or in the region of the press nip. Said heating and the associated influencing of the adhesion of the printing ink on the belt and on the printing material sheet 44 achieves a situation where the printing ink and therefore also the printing image are released substantially completely from the belt and are deposited on the printing material. As an option, a further dryer 24 which is disposed downstream of the press nip 44 can also be provided, which dryer 24 further heats the transferred printing ink and, as a result, dries and/or cures it.

Since it is advantageous for the overall process to keep the printing ink 46 at or above a defined temperature level, heating devices 25, 26, 27 and/or 28 can optionally be provided which control the temperature of the cylinders 3 and 4 from the inside and/or outside. The press roll 14 can likewise be heated.

An apparatus 29, for example a camera, for inspecting the image is likewise disposed adjacently with respect to the belt 2. By way of said apparatus 29, it can be determined via image recording and evaluation whether the printing image which is generated on the belt 2 meets the set quality requirements or, for example, has undesirable errors. Findings resulting herefrom can be used, in order to improve the printing process, for example to adapt or to regulate the application of the conditioner 47, the application of the ink droplets 45 and/or the power output of the dryer 19.

As an option, apparatuses 30*a* to 30*d* for intermediate inspection, for example cameras, or intermediate treatment, for example drying, can be provided between the print heads 16*a* to 16*d* or can be disposed immediately downstream of the latter in each case. Furthermore, apparatuses 31 and 32 for inspecting the sheets and/or an apparatus 33 for pretreating the sheets, for example by way of a primer application, and/or an apparatus 34 for aftertreatment of the sheet, for example by way of further drying, can optionally also be provided in the region of the sheet feed or delivery.

An apparatus 35 for cleaning the belt 2 is disposed adjacently with respect to the belt and is used to remove possible contaminants from the belt. Said contaminants can arise from residues of the primer, of the printing material, of the conditioner and/or of the printing inks. The cleaning apparatus can include a cleaning roll which can be set against the belt with a cleaning liquid supply means.

The liquids which are intended for use in the device 1 are provided in respective storage vessels: storage vessel 36 for cleaning liquid, storage vessel 37 for conditioning liquid, storage vessel 38 for a plurality of printing liquids, for example inks, and storage vessel 39 for primer liquid. The vessels and the associated application apparatuses are connected via feed lines (not shown).

An apparatus 40, for example a central computer, for controlling the device 1 controls the individual components of the device, in particular the print heads 16*a* to 16*d* and the dryers 19 and 23. The control apparatus is preferably connected to all the components 6, 15 to 20, 22 to 39 and 41 via data lines (not shown). Component 41 is an apparatus for changing the belt 2, which apparatus allows the previous belt to be replaced by a new one in the case of a decrease in belt quality.

In the following text, the method steps of the method according to the invention will be described in greater detail using the device which is shown in FIG. 1. The belt 2 is provided as intermediate carrier. As liquid conditioning means, the conditioner 47 is provided by way of the apparatus for application 18. Here, the first substance is already contained in the conditioner 47 or is added to it. The printing liquid is provided in storage vessels 38. Here, in the case of multiple color printing, a plurality of different printing liquids are provided which in each case include the second substance or different second substances. The printing liquid or else the printing liquids is/are applied onto the surface of the intermediate carrier 2 by means of the print heads 16*a* to 16*d*.

After the application of the conditioning medium 47 and the printing liquids 45, the printing liquid is situated as droplets or as a layer substantially on the conditioning medium. In other words, the conditioning medium is situated between the printing liquids (top) and the belt 2 (bottom). The printing liquid forms a contact region with the conditioning medium 47 on the underside of the droplets or the layer of the respective printing liquid 45. In other words, the sequence from bottom to top has to be imagined such that the belt 2 comes to lie at the very bottom, the conditioning liquid 47 on this, the contact region of the printing liquid with the conditioning medium on this, and finally the rest of the printing liquid outside the contact region at the very top.

The printing liquid is heated by way of the dryer 19 and/or the dryer 23. As a result of the heating by way of the dryer 19, solvent is expelled from the printing liquid 45 and is discharged via the air extraction means 22. The heating by way of the dryer 19 can at the same time cause the activation of the first substance and start the film formation in the contact region as a result. However, it can also be provided as an alternative to start the film formation by way of separate irradiation, for example of infrared or ultraviolet radiation.

The printing liquid 45 is transferred in the press nip 44 from the intermediate carrier 2 onto the printing material 43 which is shown as a sheet in the exemplary embodiment.

As a result of the conditioning medium and the printing liquid being layered above one another and as a result of the contact region which is formed in the process, the reaction which will be described in the following text can be limited to said contact region. The following occurs in the process: the first substance of the liquid conditioning medium 47 increases the viscosity of the printing liquid 45 on the intermediate carrier 2 in the contact region as a result of a reaction with the second substance of the printing liquid 45. As a result, the printing liquid 45 forms a film in the contact region. Instead, printing liquid outside the contact region has a lower viscosity than printing liquid within the contact region, or the printing liquid preferably maintains its original viscosity.

The layer which is formed by the conditioning medium on the intermediate carrier 2 can also be considered to be a functional intermediate layer. It is particularly preferred here to roll said functional intermediate layer onto the surface of the intermediate carrier 2 by means of an aqueous solution and in the process to form a thin layer which is as homogeneous as possible with a thickness of approximately 1 μm, but at least of less than approximately 5 μm. The applied layer of the conditioning medium is guided by means of the circulating belt 2 through the active regions of the respective print heads 16*a* to 16*d*, with the result that the printing liquid or the printing liquids can be applied onto the conditioning medium.

In one preferred embodiment, the print heads 16*a* to 16*d* apply polyacrylic-containing printing liquid. When a printing liquid of this type comes into contact with the functional intermediate layer, the printing liquid or said type of ink reacts in such a way that only its outer face which points toward the conditioning medium, that is to say a layer which is only a few nanometers thick, cures. Said layer is particularly preferably less than 10 nanometers thick. The polyacrylic therefore forms the second substance which is contained in the printing liquid. Polyvalent cations, for example Ca(2+) or Al(3+), are provided as first substance in the conditioning medium. They bring about, for example, flocculation of the dissolved polyacrylic acid. At the same time, the polymer molecules in the contact region are crosslinked and, as a result, lose their thermoplastic property. A situation can be achieved in this way where the printing liquid is not melted in a subsequent melting process, for example in the active region of the dryer 19 and/or of the dryer 23, and also remains in the solid state during the transfer process in the press nip 44. After the transfer onto the printing material 43, said crosslinked regions then no longer form a lowermost layer, but rather an uppermost layer, and therefore come to lie on the outside. As a result, the printing liquid layer does not become tacky even in the case of later heating of the printing product above the glass transition temperature of the polyacrylic acid.

Instead of the conditioning medium being rolled on, it can also be provided to spray it on. Furthermore, it can be provided to dissolve the conditioning medium in organic or partially organic solvent before its application. As an alternative, it can be provided, however, to apply the conditioning medium without solvent.

Acids, bases or catalysts can also be provided as first substance in the conditioning medium.

An apparatus 17 for belt treatment, for example for plasma treatment, is likewise disposed adjacently with respect to the belt 2. By means of the plasma or else a corona discharge, the belt surface can be cleaned and can be set into a starting state which is defined for application of liquid media with regard to the surface energy. Furthermore, an apparatus 18 for the application of conditioner is provided adjacently with respect to the belt 2. The conditioner ensures that the belt surface accepts the printing ink, that the printing ink does not undesirably spread or drip off on the belt, that the printing ink adheres to the belt during the belt transport, and that the printing ink can be transferred onto the printing material 44 in the press nip 44.

The printing ink 46 which is applied onto the belt 2 is dried at least partially by way of a hot air jet of a hot air dryer 19, by water and/or solvent being evaporated from the printing ink. The hot air is fed in via a feed 20 and the vapor which is produced by way of the drying is discharged via an air extraction means 22 which is integrated into a housing 21.

A further dryer 23, preferably an infrared dryer, is provided for further treatment, which further dryer 23 heats the printing ink, the conditioner 47 and/or the belt 2 immediately upstream of and/or in the region of the press nip. Said heating and the associated influencing of the adhesion of the printing ink on the belt and on the printing material sheet 44 achieves a situation where the printing ink and therefore also the printing image are released substantially completely from the belt and are deposited on the printing material. As an option, a further dryer 24 which is disposed downstream of the press nip 44 can also be provided, which dryer 24 further heats the transferred printing ink and, as a result, dries and/or cures it.

Since it is advantageous for the overall process to keep the printing ink 46 at or above a defined temperature level, heating devices 25, 26, 27 and/or 28 can optionally be provided which control the temperature of the cylinders 3 and 4 from the inside and/or outside. The press roll 14 can likewise be heated.

An apparatus 29, for example a camera, for inspecting the image is likewise disposed adjacently with respect to the belt 2. By way of said apparatus 29, it can be determined via image recording and evaluation whether the printing image which is generated on the belt 2 meets the set quality requirements or, for example, has undesirable errors. Findings resulting herefrom can be used, in order to improve the printing process, for example to adapt or to regulate the application of the conditioner 47, the application of the ink droplets 45 and/or the power output of the dryer 19.

As an option, apparatuses 30*a* to 30*d* for intermediate inspection, for example cameras, or intermediate treatment, for example drying, can be provided between the print heads 16*a* to 16*d* or can be disposed immediately downstream of the latter in each case. Furthermore, apparatuses 31 and 32 for inspecting the sheets and/or an apparatus 33 for pretreating the sheets, for example by way of a primer application, and/or an apparatus 34 for aftertreatment of the sheet, for example by way of further drying, can optionally also be provided in the region of the sheet feed or delivery.

An apparatus 35 for cleaning the belt 2 is disposed adjacently with respect to the belt and is used to remove possible contaminants from the belt. Said contaminants can arise from residues of the primer, of the printing material, of the conditioner and/or of the printing inks. The cleaning apparatus can include a cleaning roll which can be set against the belt with a cleaning liquid supply means.

The liquids which are intended for use in the device 1 are provided in respective storage vessels: storage vessel 36 for cleaning liquid, storage vessel 37 for conditioning liquid, storage vessel 38 for a plurality of printing liquids, for example inks, and storage vessel 39 for primer liquid. The vessels and the associated application apparatuses are connected via feed lines (not shown).

An apparatus 40, for example a central computer, for controlling the device 1 controls the individual components of the device, in particular the print heads 16*a* to 16*d* and the dryers 19 and 23. The control apparatus is preferably connected to all the components 6, 15 to 20, 22 to 39 and 41 via data lines (not shown). Component 41 is an apparatus for changing the belt 2, which apparatus allows the previous belt to be replaced by a new one in the case of a decrease in belt quality.

The method according to the invention is carried out in a plurality of process steps as follows. An intermediate carrier 2 is provided, in particular the belt which is shown or, as an alternative, a cylinder. A liquid release agent 47, in particular the conditioner which is shown, is provided in a storage vessel 37 and is applied onto the surface of the intermediate carrier 2 by way of an apparatus 18. The release agent is preferably sprayed on by way of the apparatus 18 and wets the surface of the intermediate carrier 2 completely at least in the printing image regions and forms a release layer there. One or more printing liquids, in particular the printing colors cyan, magenta, yellow and black, are provided in the storage vessels 38 and are applied onto the wetted surface of the intermediate carrier 2 in a manner which corresponds to the printing image in the form of droplets 45 by way of the print heads 16*a* to 16*d*. The applied printing liquid is heated on the circulating intermediate carrier 2 by way of the hot air dryer 19 and/or by way of the infrared dryer 23. The release agent which runs into the active region of the respective dryers 19 and/or 23 or the release layer which is formed by said release agent has a boiling temperature which is higher than the boiling temperature of the solvent of the applied printing liquid or the applied printing liquids. It is made possible in this way that solvent, in particular water, is expelled from the printing liquid, without the release agent or the release layer which is formed by it having its release action influenced negatively. Here, the expelling of the solvent from the printing liquid preferably takes place by way of the dryer 19 and the air extraction means 22. In other words, after leaving the active region of the dryer 19, there is still sufficient release agent under the printing liquid, with the result that complete or virtually complete transfer of the printing liquid can take place as a result of splitting within the release layer in the region of the press nip 44.

Furthermore, it can advantageously be provided that the release agent is increased by way of the dryer 23 to a temperature which lies higher than the boiling temperature of the release agent. Said heating of the release agent upstream of or in the region of the press nip 44 can advantageously assist the complete or virtually complete release of the printing liquid from the intermediate carrier 2.

In the following text, some concrete examples are stated as embodiments:

EXAMPLE 1

A rubber belt, preferably of comparable construction to an offset rubber blanket, is provided as intermediate carrier 2. A layer of TPnB (tripropylene glycol n-butyl ether, for example the product Dowanol TPnB) with a thickness of approximately 2 μm is applied via a spray bar 18 onto said rubber belt. Finally, a water-based and binder-based ink is applied.

EXAMPLE 2

A Teflon-coated transfer belt is provided as intermediate carrier 2. A layer of DPM (dipropylene glycol methyl ether, for example the product Dowanol DPM) with a thickness of approximately 4 μm is applied as a release layer onto said transfer belt. The application can be carried out via a roll system, in particular in a similar manner to an offset damping unit. Subsequently, a dispersion varnish layer with a thickness of from approximately 0.1 to approximately 1 μm is applied, which dispersion varnish layer is dried and therefore forms a skin on the DPM. To this end, a separate dryer can be provided which is not shown in FIG. 1 but can be disposed directly downstream of the application apparatus 18. Finally, a water-based and binder-based ink is applied, in particular what is known as a latex ink.

EXAMPLE 3

A belt or cylinder cover, the material of which is comparable with that of a known offset rubber blanket, is used as intermediate carrier 2. An oil layer with a thickness of from approximately 0.1 to approximately 1 μm is applied as a release layer onto said belt or cylinder cover, in particular a vegetable oil such as sunflower oil. Finally, an ink which is based on an organic solvent is applied.

EXAMPLE 4

A belt which is coated with silicone or a cylinder surface or a cylinder cover, the material of which otherwise is similar to that of an offset rubber blanket, is provided as intermediate carrier 2. A layer of release fluid with a thickness of approximately 6 μm is applied on top and subsequently a hot-melt ink.

EXAMPLE 5

A belt or a cylinder cover, the material of which is comparable with that of a known offset rubber blanket, is used as intermediate carrier. A layer with a thickness of from approximately 0.1 to approximately 2 μm of colorless or pigment-free offset printing ink or ink foundation is applied as a release layer onto said belt or cylinder cover. The surface tension is approximately between 0.01 N/m and 0.04 N/m. The viscosity of said printing ink can lie between 40 and 100 Pa s. Usual geometry factors for the nip between the roll which applies the release agent and the intermediate carrier belt lie between 0.001 and 0.1. In the case of printing speeds between 5 and 2 m/s, this results in surface roughnesses of the colorless release agent layer with a period of between 0.1 and 1.5 μm. Printing liquid in the form of a water-based inkjet image is applied onto this, the ink containing a solid component of between 2 and 8%, that is to say polymer particles which serve as carriers for the colorant or the pigments. The polymer particles and/or the pigments can have dimensions in the nanometer range.

The following advantages result in the case of the above-mentioned five exemplary embodiments: if a compressible intermediate carrier, for example a rubber belt, is used, this allows various substrates and, in particular, also rather rough natural papers to be printed. The use of, for example, Dowanol TPnB (with a boiling point of 274° C.) as release layer leads to an excellent release action. Said substance is a strong film formation aid and therefore improves the spreading of the printing liquid droplets. It is partially water-soluble and can be mixed with most organic solvents. This also applies similarly to Dowanol DPM. The use of water-based and binder-based inks is likewise advantageous, in particular the use of what are known as latex inks or acrylate dispersions. The latter promise similarly satisfactory mechanical resistance to UV inks, for example against scuffing. In addition, they can be dried at relatively low temperatures, at from approximately 60 to approximately 150° C.

If a transparent printing ink is used as release agent, on which the water-based ink droplets which are jetted onto it do not spread sufficiently or remain insufficiently propagated after impact, a surface roughness which is caused by way of ink splitting serves to pin the inkjet image which is placed above it. Here, in the context of a continuous process, the same roughness is set again during every revolution of the intermediate carrier, no wear occurs, and the ink splitting during the transfer of the image onto the printing material ensures complete transfer of the inkjet image, the transparent release agent protecting the printing image and it being possible for the gloss level of said covering layer to be set.

For further treatment, a further dryer 23, preferably an infrared dryer, is provided which heats the printing ink, the conditioner 47 and/or the belt 2 immediately upstream of and/or in the region of the press nip. Said heating and the associated influencing of the adhesion of the printing ink to the belt and to the printing material sheet 44 achieves a situation where the printing ink and therefore also the printing image are released substantially completely from the belt and are deposited on the printing material. As an option, a further dryer 24 which is disposed downstream of the press nip 44 can also be provided, which dryer 24 further heats the transferred printing ink and, as a result, dries and/or cures it.

Since it is advantageous for the overall process to keep the printing ink 46 at or above a defined temperature level, heating devices 25, 26, 27 and/or 28 can optionally be provided which control the temperature of the cylinders 3 and 4 from the inside and/or outside. The press roll 14 can likewise be heated.

An apparatus 29, for example a camera, for inspecting the image is likewise disposed adjacently with respect to the belt 2. By way of said apparatus 29, it can be determined via image recording and evaluation whether the printing image which is generated on the belt 2 meets the set quality requirements or, for example, has undesirable errors. Findings resulting herefrom can be used, in order to improve the printing process, for example to adapt or to regulate the application of the conditioner 47, the application of the ink droplets 45 and/or the power output of the dryer 19.

As an option, apparatuses 30*a* to 30*d* for intermediate inspection, for example cameras, or intermediate treatment, for example drying, can be provided between the print heads 16*a* to 16*d* or can be disposed immediately downstream of the latter in each case. Furthermore, apparatuses 31 and 32 for inspecting the sheets and/or an apparatus 33 for pretreating the sheets, for example by way of a primer application, and/or an apparatus 34 for aftertreatment of the sheet, for example by way of further drying, can optionally also be provided in the region of the sheet feed or delivery.

An apparatus 35 for cleaning the belt 2 is disposed adjacently with respect to the belt and is used to remove possible contaminants from the belt. Said contaminants can arise from residues of the primer, of the printing material, of the conditioner and/or of the printing inks. The cleaning apparatus can include a cleaning roll which can be set against the belt with a cleaning liquid supply means.

The liquids which are intended for use in the device 1 are provided in respective storage vessels: storage vessel 36 for cleaning liquid, storage vessel 37 for conditioning liquid, storage vessel 38 for a plurality of printing liquids, for example inks, and storage vessel 39 for primer liquid. The vessels and the associated application apparatuses are connected via feed lines (not shown).

An apparatus 40, for example a central computer, for controlling the device 1 controls the individual components of the device, in particular the print heads 16*a* to 16*d* and the dryers 19 and 23. The control apparatus is preferably connected to all the components 6, 15 to 20, 22 to 39 and 41 via data lines (not shown). Component 41 is an apparatus for changing the belt 2, which apparatus allows the previous belt to be replaced by a new one in the case of a decrease in belt quality.

The device 1 according to the invention for the indirect application of printing liquid 45 onto a printing material 43 has the belt 2 as intermediate carrier. According to the invention, a metallic coating is provided on the intermediate carrier 2. Said metallic coating can be effected, for example, by way of vapor deposition of a flexible carrier belt. As a result, a very thin metallic coating can be generated on the carrier belt 2, as a result of which the flexibility of the belt remains substantially uninfluenced. The metallic coating of the belt 2 has the advantage that irradiated heat radiation can be reflected on the surface of the metallic coating and, as a result, both the incident beam and the outgoing beam of the heat radiation pass in each case through the printing liquid 45 or the layer which is formed by it. In this way, the action of the heat radiation can be improved, for example during the intended drying of the printing liquid.

The apparatus 18 which applies a liquid release agent 47 onto the intermediate carrier 2 can be provided as first application apparatus according to the invention. According to the invention, the release agent 47 is applied as a molecular coat onto the metallic coating of the intermediate carrier 2. Here, the molecular coat has the advantage that firstly very little medium is used and therefore costs and cleaning expenditure can be reduced. Secondly, however, it also has the advantage that sufficient but still relatively little medium passes with a releasing action into the printing liquid or onto the printing material by way of a molecular coat and, as a result, possibly reduces the print quality. The quantity of media in a molecular coat is substantially negligible. The application of a molecular coat can be effected by virtue of the fact that the molecules are applied in an aqueous solution onto the metallic surface and subsequently the aqueous solution is evaporated by way of thermal energy being coupled in. Rolling over with a drying roll is also possible. The molecular coat is therefore applied in an aqueous solution and is immediately reduced to a nanoscopic layer, in particular with a thickness of less than 50 or less than 10 nanometers.

The print heads 16*a* to 16*d* which apply the printing liquid 45 onto the metallic coating of the intermediate carrier 2 only at the printing points in a manner which corresponds to the printing image can be provided as a second application apparatus according to the invention. Whereas, in the prior art, the molecular coat is therefore imaged by means of laser radiation with the use of image data, by the molecular coat being removed, for example, at the non-printing points, according to the invention the molecular coat itself is not structured and, instead, the application of the printing liquid is carried out in a structured way, that is to say in a manner which corresponds to a printing image.

The hot air dryer 19 and/or the dryer 23, in particular an infrared dryer, can be provided as heating device according to the invention. The printing liquid is heated by way of said heating device. Here, as has already been described above, the metallic coating of the intermediate carrier 2 can be advantageous as a result of its reflexivity with regard to the electromagnetic radiation.

The press nip 44 between the press roll 14 and the cylinder 13 for sheet transport can be provided as press nip according to the invention, in which press nip 44 the printing liquid 45 is transferred from the intermediate carrier 2 onto the printing material 43. According to the invention, said transfer takes place without residue or at least virtually without residue, with the result that the printing liquid is situated on the printing material downstream of the press nip and the surface of the intermediate carrier 2 advantageously does not have to be cleaned, has to be cleaned merely a little, or has to be cleaned merely rarely.

It can be advantageous to equip the intermediate carrier 2 with a thermally insulating layer, on which the metallic coating is applied. Furthermore, it can be advantageous if said thermally insulating layer at the same time has pronounced absorption with regard to irradiated electromagnetic radiation for heating the printing liquid. A layer of this type which insulates thermally and at the same time acts as a buffer store is configured, for example, as a layer which consists of yttrium-stabilized zirconium oxide, aluminum chromium nitride or of aluminum titanium chromium nitride. A layer of titanium aluminum nitride which is distinguished by a column-shaped substance structure and is a satisfactory thermal insulator is particularly preferred. Layers of this type are disclosed in conjunction with laser imaging of printing plates in offset printing in the German patent application which has not yet been published with the reference number 10 2011 110 014.1.

In the above text, the invention has been described using one exemplary embodiment, in which the intermediate carrier 2 is configured as a circulating belt. However, it is also possible to configure the intermediate carrier in the manner of a cylinder cover which is clamped on a supporting cylinder and is moved under the print heads 16*a-e* or past the processing stations which are disposed on the periphery of the cylinder.

Figure 1A:
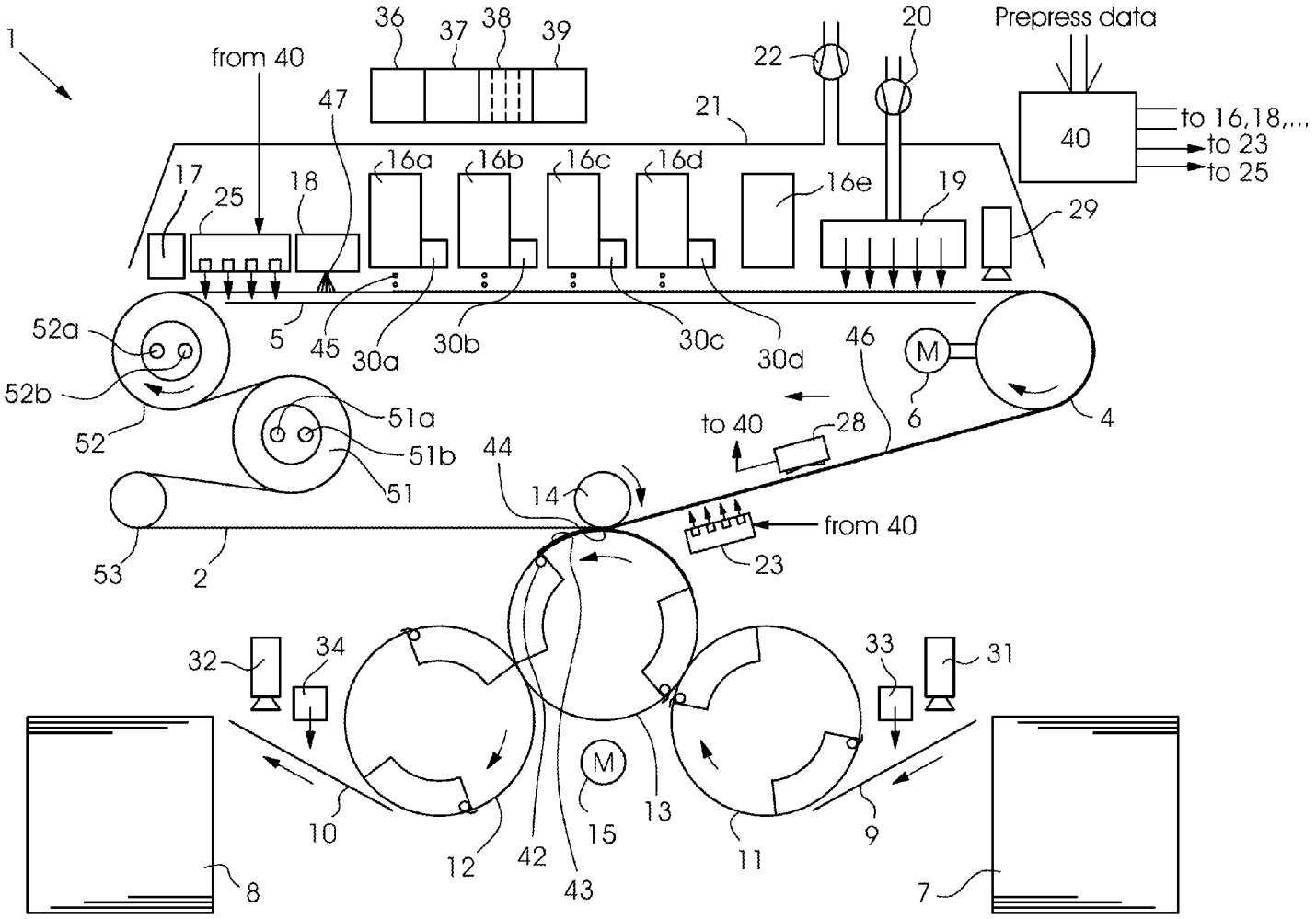
FIGS. 1A and 2A show diagrammatic views of exemplary embodiments for a device for indirect inkjet printing.

The device 1 in FIG. 1A includes a circulating belt 2 which is guided over a plurality of cylinders 4, 14, 51, 52, 53 and over a guide face 5. At least one of the cylinders 4, 14, 51, 52, 53 is driven by a motor 6 and for its part drives the belt. The guide face serves to stabilize the run of the belt in the region of the print job.

The printing material is transported in the form of individual sheets from a feed stack 7 to a delivery stack 8. The transport takes place via sheet guides which are shown in simplified form as lines 9 and 10 (they can actually be one or more transport cylinders) and by means of the sheet transport cylinders 11, 12 and 13. The latter have gripper systems 42 for the printing material sheets 43. Each individual sheet 43 runs through a press nip 44 between the cylinder 13 and a press roll or cylinder 14 which is set against the former. Said sheet transport system is driven via at least one motor 15.

Adjacently with respect to the run of the belt 2, a plurality of print heads 16*a* to 16*d* are disposed so as to follow one another, for example print heads for the customary colors cyan, magenta, yellow and black. Each print head generates ink droplets 45 of a water-based ink which are jetted onto the belt and generate ink dots there. In this way, multiple-color, halftone printing images can be generated. Since the print heads are disposed so as to follow one another in the running direction of the belt, the different ink dots also come to lie on one another partly. It can be provided that an apparatus 16*e* for print aftertreatment, for example for varnishing or for varnish application, is disposed downstream of the print heads 16*a* to 16*d*.

An apparatus 17 for belt treatment, for example for plasma treatment, is likewise disposed adjacently with respect to the belt 2. By means of the plasma or else a corona discharge, the belt surface can be cleaned and can be set into a starting state which is defined for application of liquid media with regard to the surface energy. Furthermore, an apparatus 18 for the application of conditioner is provided adjacently with respect to the belt 2. The conditioner ensures that the belt surface accepts the aqueous ink, that the ink does not undesirably spread or drip off on the belt, that the ink adheres to the belt during the belt transport, and that the ink which is subsequently solidified in the further process can be transferred onto the printing material 44 in the press nip 44.

The ink 45 which is applied onto the belt 2 is dried at least partially by way of a hot air jet of a hot air dryer 19, by water and/or solvent being evaporated from the ink. The hot air is fed in via a feed 20 and the vapor which is produced by way of the drying is discharged via an air extraction means 22 which is integrated into a housing 21.

As a result of said heating, the water which is contained in the ink evaporates and a film 46 is produced from the thermoplastic polymer particles which are contained in the ink and in which the colorant or the pigments of the ink are dissolved or to which the pigments adhere. For further treatment of the colored polymer layer (ink layer 46) which is produced in this way, a further dryer 23, preferably an infrared dryer, is provided which heats the ink layer 46 and/or the belt 2 immediately upstream of and/or in the region of the press nip. Said dryer 23 consists of one or more arrays disposed one behind another of diodes which emit IR radiation with a lens array which is connected in front for focusing the radiation onto the image dots which run past underneath, which lens array is actuated with the aid of the data of the prepress stage which are stored in the controller 40. The control operation takes place in such a way that, in accordance with the positional values of the intermediate carrier belt 2 which are supplied by an encoder 28 which scans a division on the inner side of the belt 2, only those points of the belt 2, on which image dots are also situated according to the prepress data are irradiated at the correct moment. The setting of the viscosity of the ink layer 46 which is performed in this way and the associated adhesion of the ink layer to the belt and the printing material sheet 44 achieves a situation where the ink layer and therefore also the printing image are released substantially completely from the belt and are deposited on the printing material 43.

Since it is advantageous for the overall process to keep the ink layer 46 at or above a defined temperature level during the drying process on the belt 2, further heating devices can optionally be provided, by which the surface of the intermediate carrier belt 2 is heated (not shown).

An apparatus 29, for example a camera, for inspecting the image is likewise disposed adjacently with respect to the belt 2. By way of said apparatus 29, it can be determined via image recording and evaluation whether the printing image which is generated on the belt 2 meets the set quality requirements or, for example, has undesirable errors. Findings resulting herefrom can be used, in order to improve the printing process, for example to adapt or to regulate the application of the conditioner 47, the application of the ink droplets 45 and/or the power output of the dryer 19.

As an option, apparatuses 30*a* to 30*d* for intermediate inspection, for example cameras, or intermediate treatment, for example drying, can be provided between the print heads 16*a* to 16*d* or can be disposed immediately downstream of the latter in each case. Furthermore, apparatuses 31 and 32 for inspecting the sheets and/or an apparatus 33 for pretreating the sheets, for example by way of a primer application, and/or an apparatus 34 for aftertreatment of the sheet, for example by way of further drying, can optionally also be provided in the region of the sheet feed or delivery.

The liquids which are intended for use in the device 1 are provided in respective storage vessels: storage vessel 36 for cleaning liquid, storage vessel 37 for conditioning liquid, storage vessel 38 for a plurality of printing liquids, for example inks, and storage vessel 39 for primer liquid. The vessels and the associated application apparatuses are connected via feed lines (not shown).

A central computer 40 controls the individual components of the device 1, in particular the print heads 16*a* to 16*d* and the dryers 19, 23 and 25. The computer 40 is preferably connected to all the components 6, 15 to 20, 22 to 39 via data lines (not shown).

The computer 40 also controls, in particular, a further heating device 25, preferably with the same or a similar construction as the above-described dryer 23. The heating device 25 likewise consists of an array of radiation-emitting diodes and a lens array which is connected in front for focusing the infrared radiation onto the surface of the intermediate carrier 2 which runs past underneath. The heating device 25 is also actuated by way of the data of the prepress stage and in a manner which corresponds to the positional values which are supplied by the encoder 28, to be precise in such a way that, at the correct moment, only those points of the intermediate carrier belt 2 are supplied with radiation energy, onto which image dots are also jetted by the inkjet print heads 16*a-d*. The conditioning liquid 47 evaporates immediately on said points which are preheated in this way, the ink droplets 45 which are jetted on by the inkjet heads 16*a* to 16*d* then find a conditioned belt surface there which makes spreading and fixing of the ink droplets on the belt surface possible. At the same time, the water component which is contained in the ink droplets begins to evaporate and the viscosity rises to such an extent that, when the next color is jetted on by the next head (for example, 16*b*), it is prevented that the ink droplets flow into one another.

The belt 2 is guided in a loop over three deflection cylinders 53, 52 and 51 in the region between the press nip 44 and the plasma treatment station 17, where the transport direction of the intermediate carrier belt 2 reverses, the cylinder 51 making contact with the surface of the belt 2. The belt 2 is guided with a relatively great wraparound angle around said cylinder 51, approximately 50% of the cylinder surface making contact with the belt 2 during the wraparound. The cylinder 51 is cooled or temperature controlled at a temperature $T_Z$ which lies somewhat below the setpoint temperature $T_{Soll}$ which the belt 2 or its outer layer 71 (FIG. 3) is to have when it reaches the conditioning device 18. Said temperature is to lie below 70° C. there, in order that those nozzles of the print heads 16*a-d* which are not actuated or are actuated rarely and are after all situated only approximately 1 to 2 mm above the surface of the belt 2 are not loaded excessively thermally, or in order to avoid drying or clogging of the nozzle openings. The deflection cylinders 51 and 52 can optionally also be cooled, but this is not necessary. This is because the belt 2 usually has a construction as shown in FIG. 3 and as also known in a very similar manner for the printing blankets in offset printing. Above a textile-reinforced supporting layer 73, a layer 72 of resilient rubber material, for example foam rubber, is situated which conducts heat only very poorly due to the material which is used and the porous construction. Above this, the outer layer 71 of relatively solid rubber material which conducts heat better than the layer 72 is applied, materials such as silicone rubber or nitrile rubber being used here which ensure that the inkjet image which is printed on can transfer completely onto the printing substrate 43 in the press nip 44.

Figure 2A:
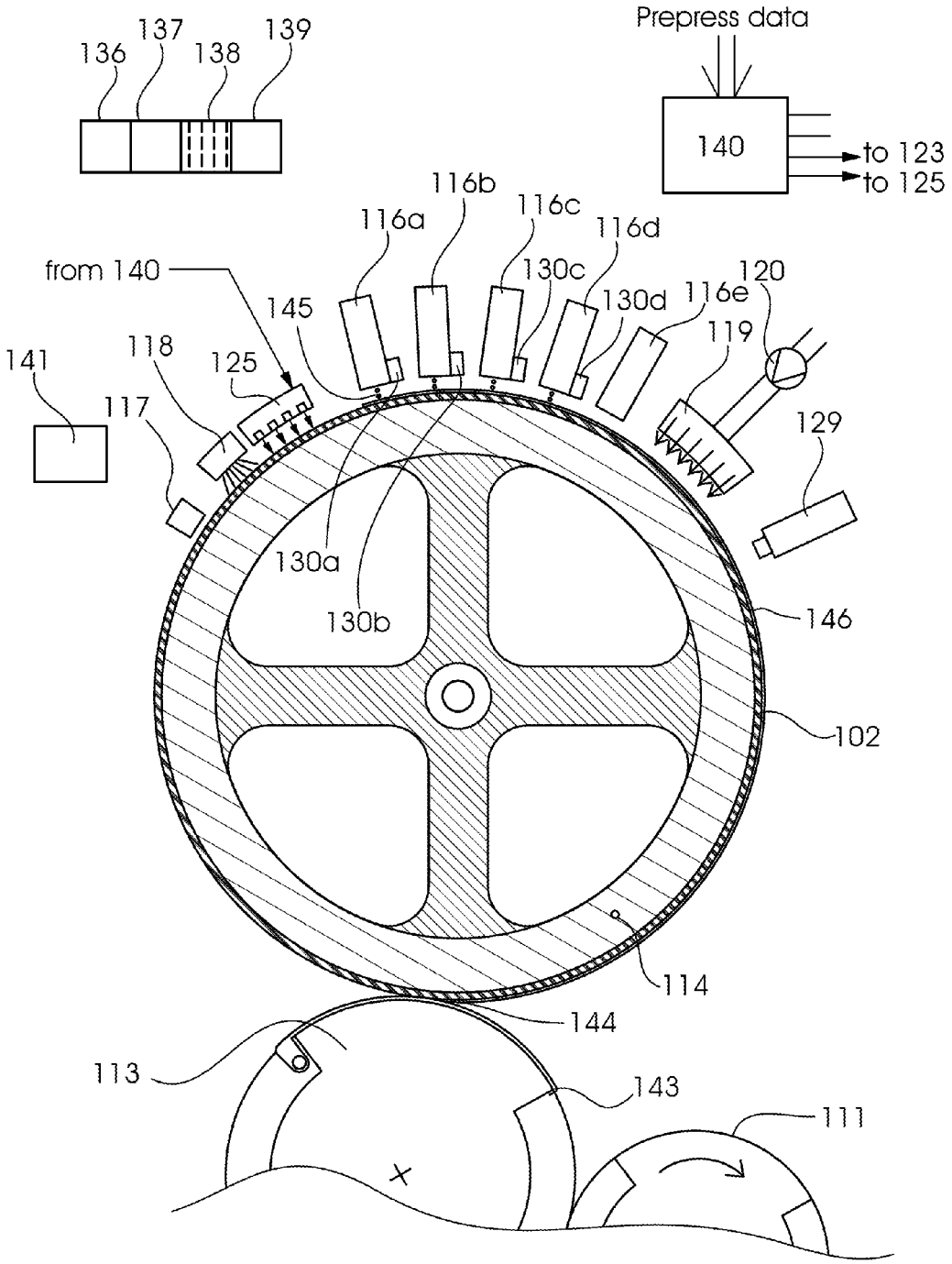
Figure 3A:
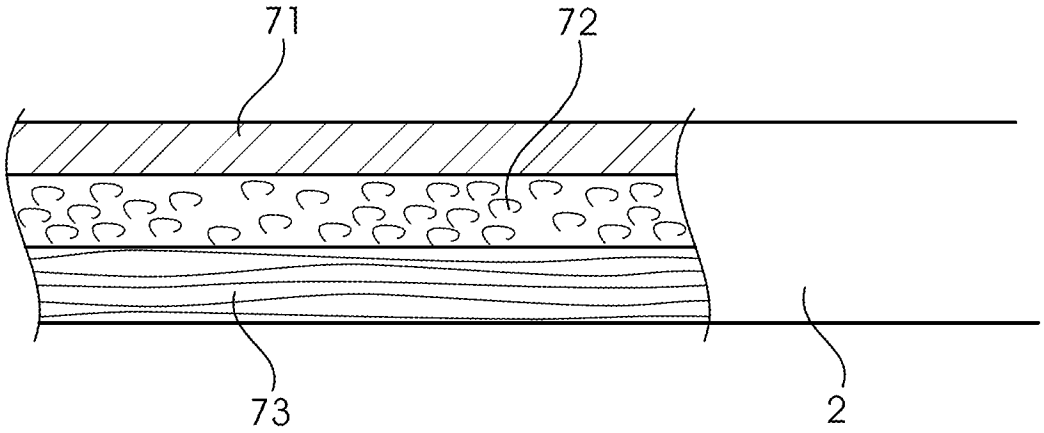
FIG. 3A shows sections through the outer layers of intermediate carriers on a greatly enlarged scale.

The exemplary embodiment of a device for indirect inkjet printing according to FIG. 2 differs from that according to FIG. 1A firstly in that a cylinder 102 is used instead of a belt as intermediate carrier, which cylinder 102 is provided on the outside with a sleeve or a rubber blanket which in principle has the same construction as described in FIG. 3A. In this exemplary embodiment, the individual constituent parts and components of the device are disposed on the periphery of the cylinder surface and in principle have the same construction and the same function as in the exemplary embodiment according to FIG. 1A. They are provided with a designation which is increased by 100 and are not to be explained in detail again at this point.

However, reference is made to the following with regard to the present invention: that surface of the cylinder 114 which is covered with a flexible, poorly thermally conducting rubber layer 102 and serves as an intermediate carrier for the images which are printed on by the print heads 116*a*-116*d* using the inkjet method has an inhomogeneous temperature profile after running through the press nip 144. This has arisen from the fact that the ink which is jetted onto the intermediate carrier surface 102 by the heads 116*a-d* cools to a more pronounced effect at the image points than in the surrounding non-image points after expelling of the water component by way of the hot air dryer 119. Said in homogeneous temperature profile also still exists when the intermediate carrier runs through under the device 117 for plasma treatment of the surface and has conditioner applied onto the surface by the conditioning device 125. An infrared laser diode array 125, for example a VCSEL array, is then disposed between the conditioning device 125 and the first inkjet print head 116*a*, which infrared laser diode array 125 loads the surface of the poorly conducting outer rubber layer 102 of the intermediate carrier with high-energy laser radiation only at the points, onto which the printing image is later jetted, and thus writes a higher temperature profile onto the surface of the intermediate carrier at the image points than at the surrounding non-image points. For this purpose, the laser diode array 118 is connected to the controller 140 which knows both the prepress data and the instantaneous angular position of the cylinder 114 (which is scanned by an encoder (not shown)). On the image points which are preheated in this way, the water or solvent in the ink which is jetted on by the heads 116*a*-116*d* evaporates at least to such an extent that the viscosity of the ink droplets which is then increased prevents the different inks from running into one another or mixing before they are finally dried by the hot air dryer 119 to form a permanent polymer film (ink layer 146) which is then transferred onto the printing product 143 as an image in the press nip 144.

Figure 1B:
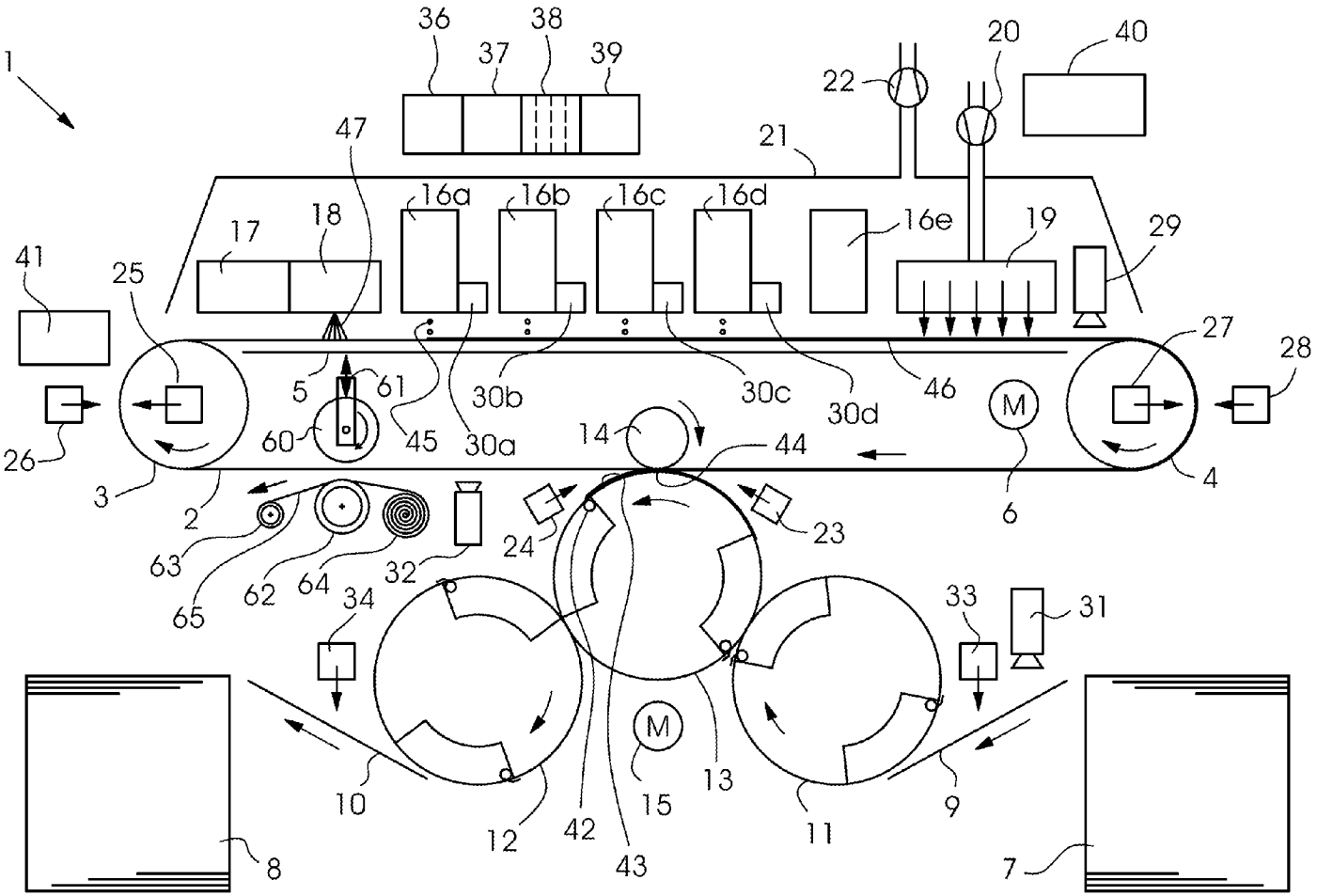
FIG. 1B shows a diagrammatic view of one exemplary embodiment for a device for indirect inkjet printing.

The device 1 in FIG. 1B includes a circulating belt 2 which is guided over a plurality of cylinders 3, 4, 14 and over a guide face 5. At least one of the cylinders 3, 4, 14 is driven by a motor 6 and for its part drives the belt. The guide face serves to stabilize the run of the belt in the region of the print job.

The printing material is transported in the form of individual sheets from a feed stack 7 to a delivery stack 8. The transport takes place via sheet guides which are shown in simplified form as lines 9 and 10 (they can actually be one or more transport cylinders) and by means of the sheet transport cylinders 11, 12 and 13. The latter have gripper systems 42 for the printing material sheets 43. Each individual sheet 43 runs through a press nip 44 between the cylinder 13 and a pressing roll 14 which is set against the former. Said sheet transport system is driven via at least one motor 15.

Adjacently with respect to the run of the belt 2, a plurality of print heads 16*a* to 16*d* are disposed so as to follow one another, for example print heads for the customary colors cyan, magenta, yellow and black. Each print head generates ink droplets 45 of a water-based ink which are jetted onto the belt and generate ink dots there. In this way, multiple-color, halftone printing images can be generated. However, it can also be provided that the ink droplets of one color run into one another at least at some points and therefore form closed color areas. Since the print heads are disposed so as to follow one another in the running direction of the belt, the different ink dots also come to lie on one another partly. It can be provided that an apparatus 16*e* for print aftertreatment, for example for varnishing or for varnish application, is disposed downstream of the print heads 16*a* to 16*d*, which apparatus 16*e* is either likewise configured as an inkjet head or is configured as a conventional varnishing unit which brings about the varnish application via application rolls or with the aid of a small number of spray nozzles and thus covers the full surface area of the surface of the belt 2 with varnish or other fluids. The varnish can be pigment-free ink which otherwise has the same properties, in particular drying properties, as the ink 45 which is jetted onto the belt 2 by the heads 16*a-d*.

An apparatus 17 for belt treatment, for example for plasma treatment, is likewise disposed adjacently with respect to the belt 2. By means of the plasma or else a corona discharge, the belt surface can be cleaned and can be set into a starting state which is defined for application of liquid media with regard to the surface energy. Furthermore, an apparatus 18 for the application of conditioner is provided adjacently with respect to the belt 2. The conditioner ensures that the belt surface accepts the aqueous ink, that the ink does not undesirably spread or drip off on the belt, that the ink adheres to the belt during the belt transport, and that the ink which is subsequently solidified in the further process can be transferred onto the printing material 44 in the press nip 44.

The ink 45 which is applied onto the belt 2 is dried at least partially by way of a hot air jet of a hot air dryer 19, by water and/or solvent being evaporated from the ink. The hot air is fed in via a feed 20 and the vapor which is produced by way of the drying is discharged via an air extraction means 22 which is integrated into a housing 21.

For further treatment, a further dryer 23, preferably an infrared dryer, is provided which heats the ink, the optionally applied varnish, the conditioner 47 and/or the belt 2 immediately upstream of and/or in the region of the press nip. By way of said heating, the water which is contained in the ink or the varnish evaporates and a tacky film is produced. The associated influencing of the adhesion of the film on the belt and on the printing material sheet 44 achieves a situation where the film and therefore also the printing image are released substantially completely from the belt and are deposited on the printing material. As an option, a further dryer 24 which is disposed downstream of the press nip 44 can also be provided, which dryer 24 further heats the ink film which is already surface dried and, as a result, dries and/or cures it, for example by way of radiation.

Since it is advantageous for the overall process to keep the surface dried ink film, that is to say the printing ink 46, at or above a defined temperature level, heating devices 25, 26, 27 and/or 28 can optionally be provided which control the temperature of the cylinders 3 and 4 from the inside and/or outside. The pressing roll 14 can likewise be heated.

It is also to be mentioned at this point that the configuration and the type of the various heating devices can be selected to be different, in order to optimize the printing process overall. For example, the hot air dryer 20 can also be disposed upstream of the apparatus 16*e* for print aftertreatment in the belt running direction, in order first of all to surface dry the image on the intermediate carrier 2 before it is then coated with varnish, for example.

An apparatus 29, for example a camera, for inspecting the image is likewise disposed adjacently with respect to the belt 2. By way of said apparatus 29, it can be determined via image recording and evaluation whether the printing image which is generated on the belt 2 meets the set quality requirements or, for example, has undesirable errors. Findings resulting herefrom can be used, in order to improve the printing process, for example to adapt or to regulate the application of the conditioner 47, the application of the ink droplets 45 and/or the power output of the dryer 19.

As an option, apparatuses 30*a* to 30*d* for intermediate inspection, for example cameras, or intermediate treatment, for example drying, can be provided between the print heads 16*a* to 16*d* or can be disposed immediately downstream of the latter in each case. Furthermore, apparatuses 31 for inspecting the sheets can optionally also be provided in the region of the sheet feed or delivery or apparatuses 32 for inspecting the belt surface after the print and/or an apparatus 33 for pre-treating the sheets, for example by way of a primer application, and/or an apparatus 34 for aftertreatment of the sheet, for example by way of further drying, can optionally also be provided downstream of the press nip 44.

The liquids which are intended for use in the device 1 are provided in respective storage vessels: storage vessel for cleaning liquid, storage vessel 37 for conditioning liquid, storage vessel 38 for a plurality of inks, for example inks, and storage vessel 39 for primer liquid. The vessels and the associated application apparatuses are connected via feed lines (not shown).

A central computer 40 controls the individual components of the device 1, in particular the print heads 16*a* to 16*d* and the dryers 19 and 23. The computer 40 is preferably connected to all the components 6, 15 to 20, 22 to 39 and 41 via data lines (not shown). Component 41 is an apparatus for changing the belt 2, which apparatus allows the previous belt to be replaced by a new one in the case of a decrease in belt quality.

A device 60 to 65 is optionally inserted in the region between the press nip 44 and the transport roll 3, where the transport direction of the intermediate carrier belt 2 reverses, with the aid of which device 60 to 65 remaining residual parts of the printing ink 46 which are not transferred onto the sheet 43 in the press nip 44 can be printed off from the surface of the belt 2. Said device has a counter-roller 62, over which a plastic belt 65 is guided which is unwound from a reel 64 and is wound onto a reel 63. The film 65 consists either of smooth coated paper or of plastic such as polyamide or polycarbonate with satisfactorily ink-absorbing properties and high surface energy in comparison with the surface of the belt 2 which consists of silicone rubber, Teflon or a similar material with a lower surface energy which absorbs the printing ink less satisfactorily or releases it more readily.

If the camera 32 determines that ink residues are still present on the surface of the belt 2 due to faulty transfer in the press nip, or that said ink residues exceed a defined magnitude, first of all the jetting operation of the ink droplets 45 is interrupted, that is to say no further new printing image is jetted onto the intermediate carrier belt 2. As soon as the last image has been transferred from the intermediate carrier 2 onto the paper sheet 43 in the press nip 44, the cleaning procedure is initiated. This can begin with the machine first of all being brought to a standstill and optionally the printing pressure at the press nip 44 being thrown off, with the result that the belt 2 can subsequently move freely between the impression cylinder 13 and the pressing roll 14. The actual cleaning procedure begin subsequently. Here, the belt and the film 65 are brought mutually into contact by a pressing roll 60 on the rear side of the belt 2, as symbolized by the arrow 61, that is to say the belt surface is pressed against the film 65. The belt 2 and the film 65 are then moved forward in mutual contact at the same speed. To this end, the cores of the reels 63 and 64 are provided with drives which are likewise moved synchronously with the motor 6 of the belt drive by the controller 40, to be precise until the entire length of the belt 2 has passed once between the rollers 60 and 62. Here, all ink residues which are still situated on the belt 2 are transferred onto the film 65. The camera 32 monitors the success of the cleaning procedure in a second pass, with the result that the printing process can be resumed again if no further ink residues are detected.

Figure 2B:
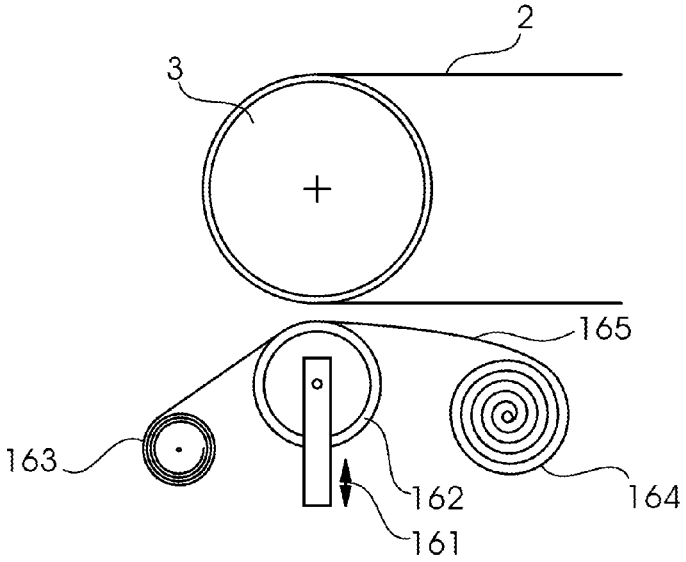
FIGS. 2B, 3B, 4B and 5B show different exemplary embodiments as an alternative to the printing device 60 to 65 in FIG. 1B, on an enlarged scale in comparison with FIG. 1B, FIGS. 1D and 2D show diagrammatic views of exemplary embodiments for a device for indirect inkjet printing.
Figure 3B:
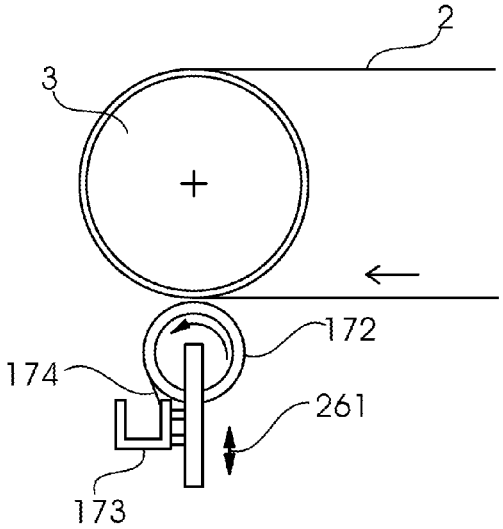

The separate pressing roll 60 can be dispensed with if the remaining constituent parts of the device are disposed as shown in FIG. 2B, that is to say are displaced into the region below the deflection roll 3. In this case, the elastic roll 162, over which the cleaning film 165 is guided, can be moved in the direction of the arrow 161 and, at the beginning of the cleaning sequence, presses the film 165 against the underside of the deflection roll 3 and therefore against the surface of the belt 2 which is laid over it. Otherwise, the method of operation is the same as described using FIG. 1B.

It is also possible to dispose the cleaning printing device in the region of the belt 2 between the deflection roller 4 and the press nip 44 if, for example, the infrared dryer 28 assumes the function of the dryer 23.

The paper or plastic belt 65 or 165 can be wound to and fro multiple times until it has absorbed so many ink residues that the reel 63 is to be replaced. However, in particular when cleaning procedures have to be carried out only occasionally with low ink residues, an endless belt can also be used instead of a belt reel.

Figure 3D:
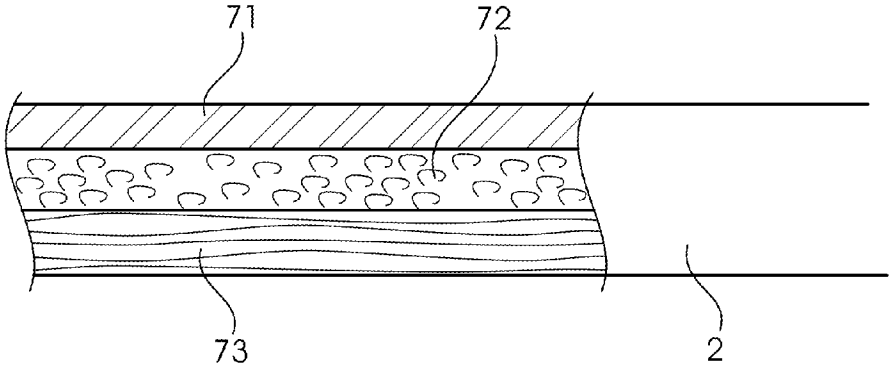
FIGS. 3D and 4D shows sections through the outer layers of intermediate carriers on a greatly enlarged scale.

In the embodiment according to FIG. 3D, a separate film which can be wound up and unwound for receiving the ink residues from the belt surface is dispensed with in comparison with FIG. 2B. Instead, a roll 172 which can be set against the deflection roll 3 or the belt 2 which is laid over it and is composed of a material which absorbs ink satisfactorily, such as copper or Rilsan, is provided below said deflection roll 3. A doctor blade 174 which doctors the ink residues from the surface of the roll 172 and collects them in a collecting vessel 173 bears against the surface of said roll 162. Said "ink receiving roll 172" rotates at the same circumferential speed as the deflection roll 3 or the belt 2 which is laid over it and therefore does not exert any great mechanical loading on the belt surface. The force of the setting movement (symbolized by the arrow 261) of the roll 172 and/or the contact pressure which the roll 172 exerts on the belt surface can be set or regulated in such a way that ink residues are removed reliably from the belt 2, but to a value which is not higher than absolutely necessary.

Figure 4B:
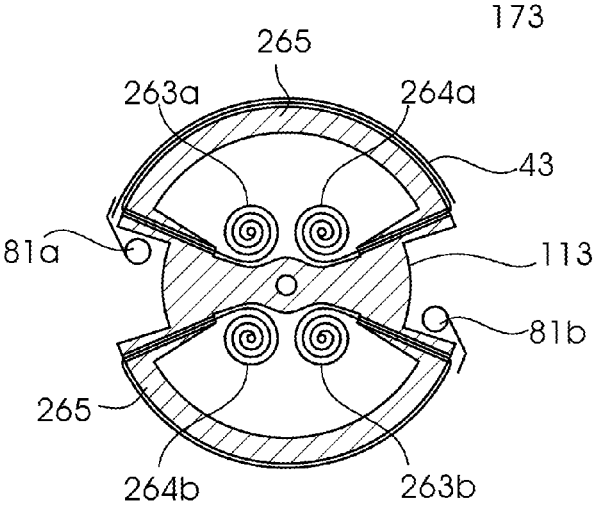

In the alternative embodiment according to FIG. 4B, the device 60 to 65 in FIG. 1B is dispensed with. Instead, the impression cylinder which is denoted by 13 in FIG. 1 and transports the sheet 43 to be printed is replaced by a special impression cylinder 113. In its interior, said impression cylinder 113 has two reel pairs 263*a*/264*a* and 263*b*/264*b*, from which a roll of smooth paper is laid over the two cylinder segments which lie opposite one another and normally press the sheet 43 to be printed which is held by the grippers 81*a* and 81*b* against the surface of the belt 2. By way of a device which is not shown here, the respective paper belt is unwound from one reel (for example, 263*a*) and is wound onto the receiving reel 264*a* in a similar way as described in patent document US RE. 36,275 of the applicant for an offset printing film in a sheet-fed planographic printing press which can be imaged directly.

If the camera 32 in the device according to FIG. 1B then detects ink residues on the surface of the belt 2, the print for the next number of sheets which are positioned on the belt surface is interrupted depending on the length of the belt and the corresponding quantity of sheets 9 to be printed are retained on the stack 7. As soon as the last printing sheet 43 has then therefore passed the press nip 44, the surface of the belt 2 no longer finds a sheet 43 to be printed in the press nip 44, but rather instead the smooth surface of the cleaning paper reel which is pulled over the respective cylinder segment. The ink residues are then deposited on said smooth paper surface, whereupon the surface of the belt 2 is again ink-free and can again continue to fully fulfill its function as intermediate carrier. As soon as the paper reel has absorbed sufficient residual ink after a plurality of cleaning sequences over the cylinder segments, the drives for the reels 263*a*/264*a* and 264*b* and 263*b* are actuated and fresh paper is tensioned over the cylinder segments.

Figure 5B:
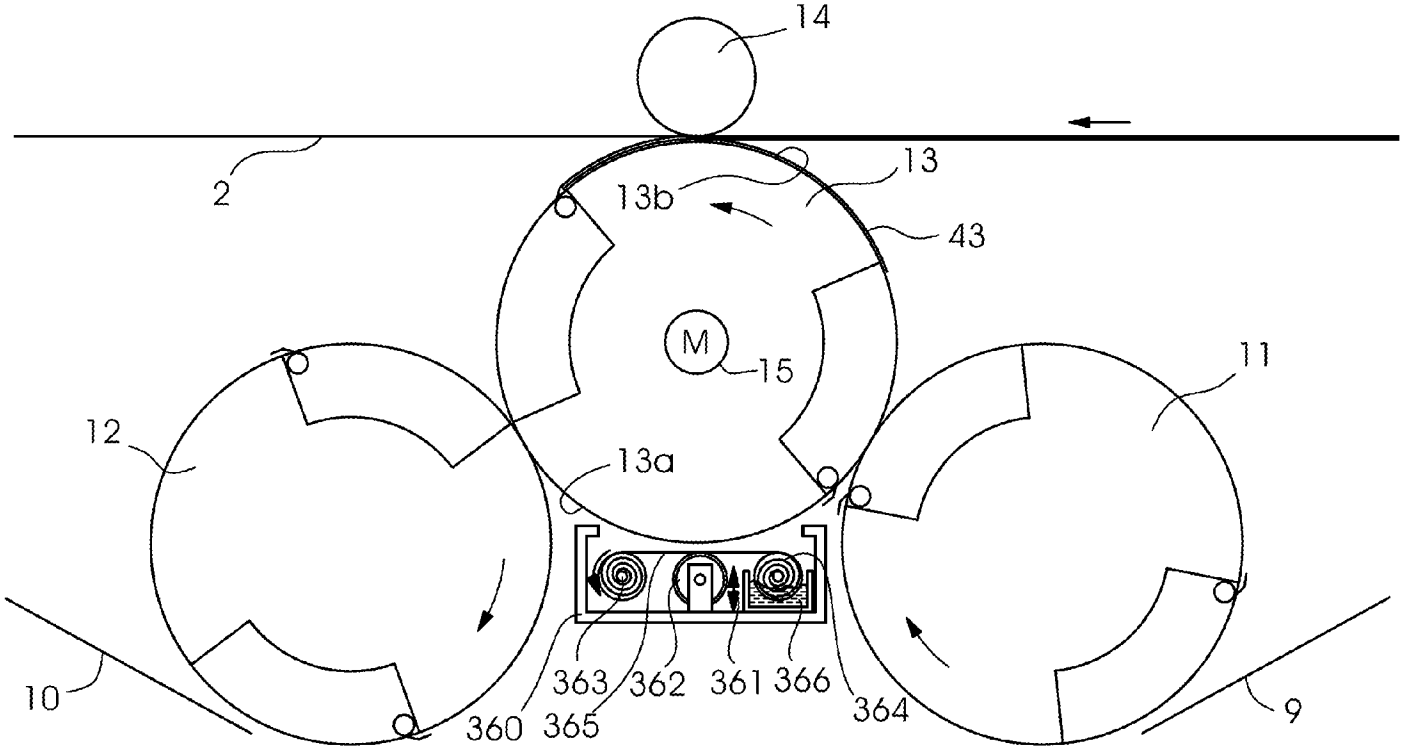

In the embodiment according to FIG. 5B, the installation of paper reels in the impression cylinder 13 or 113 is dispensed with. Instead, the segments of the impression cylinder 13 have a very smooth surface 13*a*, 13*b* made from a material which satisfactorily absorbs ink, such as Rilsan or copper, in a similar manner to the roll 172 from FIG. 3B. Instead, as in the preceding description of FIG. 4, the disruptive residual ink is printed from the belt surface 2 onto said surfaces during a cleaning sequence. The surfaces 13*a*, 13*b* of the impression cylinder 13 are then removed at regular greater intervals by way of a cloth washing device which is disposed underneath. The cloth washing device has the following construction: two reels 363 and 364 are situated in a box 360 which is disposed below the impression cylinder 13, the reel 364 being the supply reel, from which a washing cloth 365 is unwound and is wound up by the reel 363. The washing cloth reel 364 is dampened with cleaning liquid in a tank 366. For the purpose of cleaning the surface of the impression cylinder 13 from the ink residues which are removed from the belt 2, a pressing roll 362 is moved toward the impression cylinder in the direction of the fold 361 and presses the washing cloth 365 against its surface, while the impression cylinder 13 moves further and the washing cloth 365 is also wound further at a lower speed, in order to absorb the ink from the outer faces 13*a*, 13*b* of the cylinder segments.

Instead of the cloth washing device, however, a brush washing device or another washing device can also be used which, in satisfactory mechanical contact with the resistant surface of the impression cylinder, sets the latter again into a clean state which absorbs ink.

Here, the cleaning procedure proceeds as follows: at relatively great time intervals or if the camera sensor 32 (FIG. 1B) detects the contamination of the surface of the belt 2, the paper transport from the stack 7 is interrupted, to be precise for as many sheets as can be printed in one belt pass if the entire belt is to be cleaned, or for correspondingly fewer sheets if only part of the belt is to be cleaned. Synchronously with respect to said interruption, the jetting of the belt surface with the ink droplets 45 is also interrupted, to be precise in such a way that the last printing sheet 43 which still passes the press nip 45 still receives the last image which is situated on the belt surface. Subsequently, the belt 2 runs further and remaining ink residues are deposited on the surfaces 13*a*, 13*b* of the impression cylinder 13 which absorb ink to a pronounced extent, the contamination being collected on said impression cylinder 13. When the surface of the belt 2 is cleaned, the printing process is restarted with the removal of the sheets 9 from the stack 7 and further printing. Before this happens, the surface of the impression cylinder 13 can be cleaned by way of the washing device 360 to 366, in order to avoid possible depositing of the ink residues which are situated on the impression cylinder on the rear side of the printing material, that is to say the sheet 43, which is conveyed by it in the press nip.

Said cleaning of the impression cylinder 13 can be dispensed with or can be necessary only at relatively great intervals if it is ensured with a suitable selection of the material of the surface of the impression cylinder 13 that the ink residues remain adhered to it and are not transferred onto the rear side of the paper sheets 43 to be covered.

According to further method variants according to the invention, the above-described cleaning devices can be dispensed with completely under certain preconditions. The first further variant of the invention consists in the fact that, if the stack 7 in FIG. 1B contains uncoated paper, the sheets 9, 43, 10 which are conveyed away from it therefore have a comparatively rough surface and the ink residues which remain on the belt surface and are detected by the camera 32 can be attributed, in particular, to said rough printing material surface, the following procedure proceeds at regular intervals. If contaminants are detected, a printing substrate with different surface properties is inserted into the paper transport path instead of an uncoated paper sheet, or a plurality of sheets one behind another, depending on the length of the belt 2 which is used, and is conveyed through the press nip 44 by the cylinders 11, 13, 12. This can be, for example, smooth coated paper or films. The contaminants can then be printed from the belt surface onto said so-called spoilage sheets because they display a very much improved ink receiving behavior in comparison with the uncoated paper. The procedure can then be carried out in such a way that the inkjet printing is stopped during the cleaning procedure, or else that the inkjet printing is continued and the contaminants of the belt including the image which is printed over them are conveyed away and ejected as spoilage. The device 60 to 65 according to FIG. 1 is also dispensable in this case. For the reliable transfer of the ink residues in the press nip 44 onto said spoilage sheet, they can be heated again shortly upstream of the press nip 44 with the aid of the infrared dryer 23, in order to improve the receiving behavior by way of the spoilage sheet.

The procedure can be carried out as follows in an additional variant of the method according to the invention, in particular when the remaining ink residues on the surface of the belt 2 are not to be attributed to the use of uncoated paper as printing material: after they have been detected with regard to position and size by the camera sensor 32, the ink residues are again coated in a greater region with ink by the inkjet heads 16*a* to 16*d* during the cleaning sequence, which ink is joined to the ink residues and is subsequently solidified by way of the dryers 19, 27, 28, 23 as described. Said relatively large contiguous regions of the printing ink can then be transferred reliably in the press nip 44 onto the sheet 43 to be printed which is then likewise removed as spoilage sheet.

In a further variant, the surface of the belt 2 can also be sprayed relatively thickly with a fluid over the full surface area via the apparatus 16*e* for print aftertreatment, for example a spraying device which is inserted at the point, which fluid, as in the above-described way, is either dried by heat or contains radiation-curing substances which are then cured by a UV lamp which is disposed at the point of the hot air dryer 19. A solid film which is thicker than the ink layer is therefore produced on the belt surface over the entire belt surface, but at least the contaminated part of the belt surface, and said film can then be transferred without problems in the press nip 44 from the ink-repelling surface of the belt 2 onto the ink-receiving printing material sheet. In this way, all the remaining contaminants are removed from the belt 2 and are likewise transferred onto a spoilage sheet. In this method variant, it is also possible to use one of the apparatuses shown in FIGS. 1B to 5B, for example that according to FIG. 3B, to remove the cured film from the belt surface instead of the spoilage sheets. In this case, after the roll 172 is set against the belt surface, the cured film adheres to the surface of the roll 172 and is removed from the belt surface by said roll 172 with the remaining contaminants which adhere to the film. The doctor blade 172 then again peels the cured film from the roll 172.

In this case, the cleaning procedure is such that, at intervals or after contamination of the belt surface has been determined by way of the camera sensor 32, the paper transport and the printing of the belt 2 is interrupted for a number of sheets and, while the belt is continuing to run, instead the above-described fluid which cures by way of heat or radiation is applied onto the belt 2 and, after the impression cylinder 13 is thrown off and the roll 172 is thrown on, the film of the cured fluid is removed from the belt 2 by said roll 172.

Figure 1D:
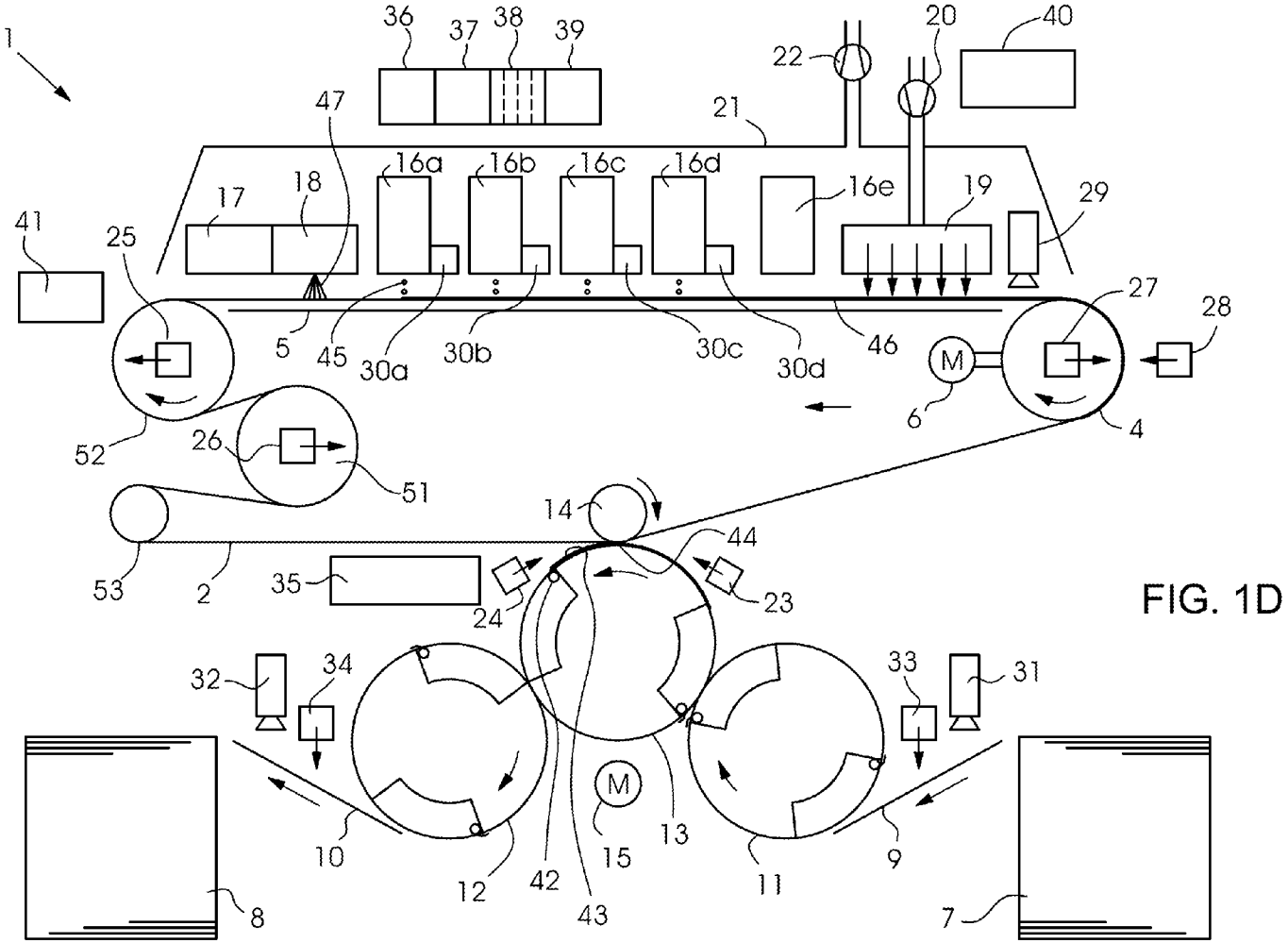

The device 1 in FIG. 1D includes a circulating belt 2 which is guided over a plurality of cylinders 4, 14, 51, 52, 53 and over a guide face 5. At least one of the cylinders 4, 14, 51, 52, 53 is driven by a motor 6 and for its part drives the belt. The guide face serves to stabilize the run of the belt in the region of the print job.

The printing material is transported in the form of individual sheets from a feed stack 7 to a delivery stack 8. The transport takes place via sheet guides which are shown in simplified form as lines 9 and 10 (they can actually be one or more transport cylinders) and by means of the sheet transport cylinders 11, 12 and 13. The latter have gripper systems 42 for the printing material sheets 43. Each individual sheet 43 runs through a press nip 44 between the cylinder 13 and a press roll 14 which is set against the former. Said sheet transport system is driven via at least one motor 15.

Adjacently with respect to the run of the belt 2, a plurality of print heads 16*a* to 16*d* are disposed so as to follow one another, for example print heads for the customary colors cyan, magenta, yellow and black. Each print head generates ink droplets 45 of a water-based ink which are jetted onto the belt and generate ink dots there. In this way, multiple-color, halftone printing images can be generated. However, it can also be provided that the ink droplets of one color run into one another at least at some points and therefore form closed color areas. Since the print heads are disposed so as to follow one another in the running direction of the belt, the different ink dots also come to lie on one another partly. It can be provided that an apparatus 16*e* for print aftertreatment, for example for varnishing or for varnish application, is disposed downstream of the print heads 16*a* to 16*d*.

An apparatus 17 for belt treatment, for example for plasma treatment, is likewise disposed adjacently with respect to the belt 2. By means of the plasma or else a corona discharge, the belt surface can be cleaned and can be set into a starting state which is defined for application of liquid media with regard to the surface energy. Furthermore, an apparatus 18 for the application of conditioner is provided adjacently with respect to the belt 2. The conditioner ensures that the belt surface accepts the aqueous ink, that the ink does not undesirably spread or drip off on the belt, that the ink adheres to the belt during the belt transport, and that the ink which is subsequently solidified in the further process can be transferred onto the printing material 44 in the press nip 44.

The ink 45 which is applied onto the belt 2 is dried at least partially by way of a hot air jet of a hot air dryer 19, by water and/or solvent being evaporated from the ink. The hot air is fed in via a feed 20 and the vapor which is produced by way of the drying is discharged via an air extraction means 22 which is integrated into a housing 21.

For further treatment, a further dryer 23, preferably an infrared dryer, is provided which heats the ink, the conditioner 47 and/or the belt 2 immediately upstream of and/or in the region of the press nip. Said heating evaporates the water which is contained in the ink and a tacky film is produced. The associated influencing of the adhesion of the ink on the belt and on the printing material sheet 44 achieves a situation where the ink and therefore also the printing image are released substantially completely from the belt and are deposited on the printing material. As an option, a further dryer 24 which is disposed downstream of the press nip 44 can also be provided, which dryer 24 further heats the ink film which is already surface dried and, as a result, dries and/or cures it, for example by way of radiation.

Since it is advantageous for the overall process to keep the surface dried ink 46 at or above a defined temperature level, heating devices 25, 26, 27 and/or 28 can optionally be provided which control the temperature of the cylinders 3 and 4 from the inside and/or outside. The press roll 14 can likewise be heated.

An apparatus 29, for example a camera, for inspecting the image is likewise disposed adjacently with respect to the belt 2. By way of said apparatus 29, it can be determined via image recording and evaluation whether the printing image which is generated on the belt 2 meets the set quality requirements or, for example, has undesirable errors. Findings resulting herefrom can be used, in order to improve the printing process, for example to adapt or to regulate the application of the conditioner 47, the application of the ink droplets 45 and/or the power output of the dryer 19.

As an option, apparatuses 30*a* to 30*d* for intermediate inspection, for example cameras, or intermediate treatment, for example drying, can be provided between the print heads 16*a* to 16*d* or can be disposed immediately downstream of the latter in each case. Furthermore, apparatuses 31 and 32 for inspecting the sheets and/or an apparatus 33 for pretreating the sheets, for example by way of a primer application, and/or an apparatus 34 for aftertreatment of the sheet, for example by way of further drying, can optionally also be provided in the region of the sheet feed or delivery.

An apparatus 35 for cleaning the belt 2 is disposed adjacently with respect to the belt and is used to remove possible contaminants from the belt. Said contaminants can arise from residues of the primer, of the printing material, of the conditioner and/or of the printing inks. The cleaning apparatus can include a cleaning roll which can be set against the belt with a cleaning liquid supply means.

The liquids which are intended for use in the device 1 are provided in respective storage vessels: storage vessel 36 for cleaning liquid, storage vessel 37 for conditioning liquid, storage vessel 38 for a plurality of printing liquids, for example inks, and storage vessel 39 for primer liquid. The vessels and the associated application apparatuses are connected via feed lines (not shown).

A central computer 40 controls the individual components of the device 1, in particular the print heads 16*a* to 16*d* and the dryers 19 and 23. The computer 40 is preferably connected to all the components 6, 15 to 20, 22 to 39 and 41 via data lines (not shown). Component 41 is an apparatus for changing the belt 2, which apparatus allows the previous belt to be replaced by a new one in the case of a decrease in belt quality.

The belt 2 is guided in a loop over three deflection cylinders 53, 52 and 51 in the region between the press nip 44 and the plasma treatment station 17, where the transport direction of the intermediate carrier belt 2 reverses, the cylinder 51 making contact with the surface of the belt 2.

The belt 2 is guided with a relatively great wraparound angle around said metal cylinder 51, approximately 50% of the cylinder surface making contact with the belt 2 during the wraparound. The cylinder 51 is heated or temperature controlled at a temperature $T_Z$ which lies somewhat above the setpoint temperature $T_{Soll}$ which the belt 2 or its outer layer 71 (FIG. 3D) is to have when it reaches the conditioning device 18. Said temperature can certainly lie above 100° C., typically at 120° C. The temperature control devices which are known in the graphic industry for temperature control of rolls or cylinders in printing presses and which operate with high boiling point temperature control liquids such as glycol, in order to heat the cylinder 51 on its surface to temperatures of approximately 120°, are suitable for temperature control. The deflection cylinders 51 and 52 can optionally also be heated, in order to impart a certain base thermal load to the intermediate carrier belt 2, but this is not necessary. This is because the belt 2 usually has a construction as shown in FIG. 3D and as also known in a very similar manner for the printing blankets in offset printing. Above a textile-reinforced supporting layer 73, a layer 72 of resilient rubber material, for example foam rubber, is situated which conducts heat only very poorly due to the material which is used and the porous construction. Above this, the outer layer 71 of relatively solid rubber material which conducts heat better than the layer 72 is applied, materials such as silicone rubber or nitrile rubber being used here which ensure that the inkjet image which is printed on can transfer completely onto the printing substrate 43 in the press nip 44.

Via the cylinder 51, lateral temperature differences of 20° C. in the outer layer 71 can be dissipated apart from a no longer disruptive amount of ±2° C. via the surface of the layer 71 of the intermediate carrier 2.

Figure 2D:
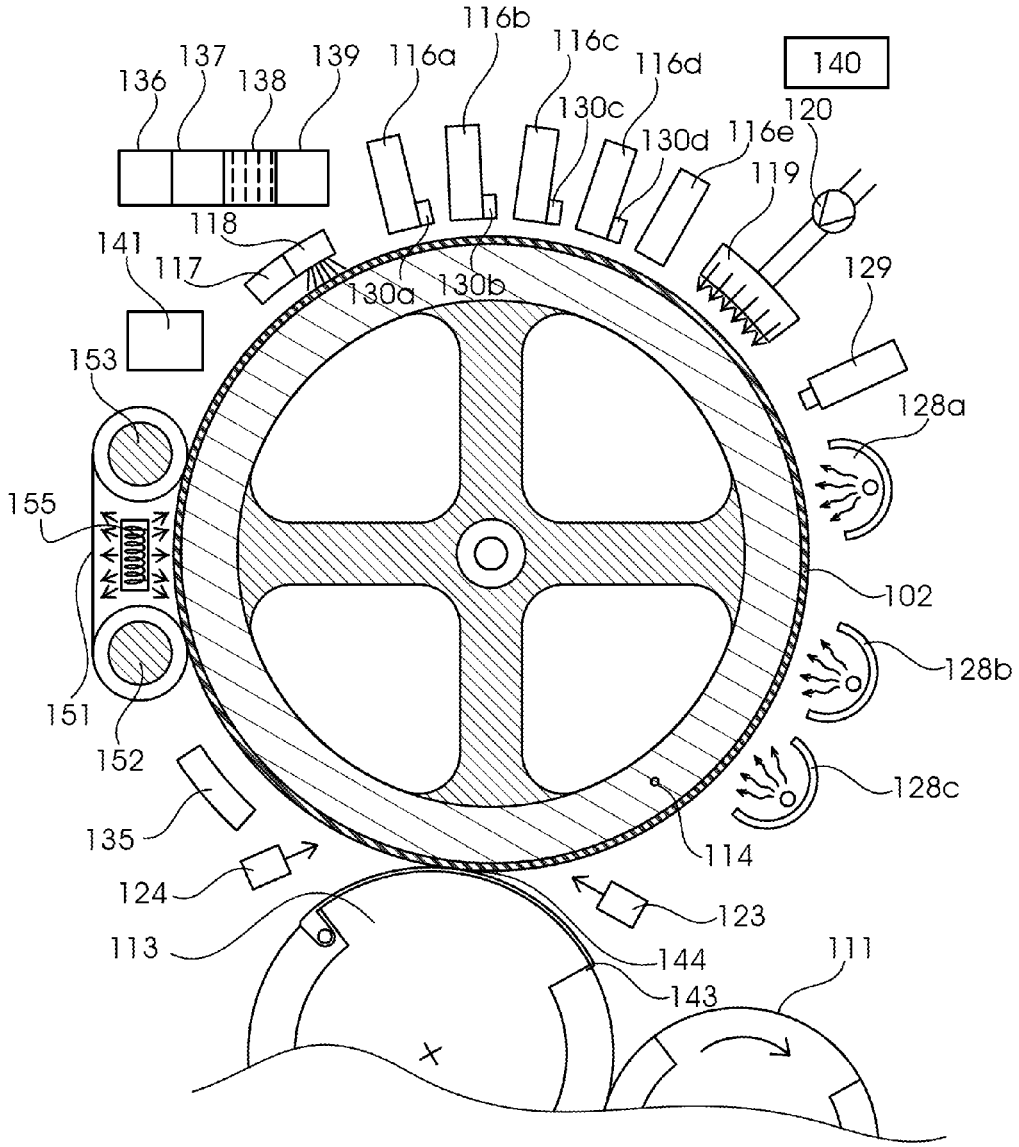

The exemplary embodiment of a device for indirect inkjet printing according to FIG. 2*d* differs from that according to FIG. 1D firstly in that a cylinder 102 is used instead of a belt as intermediate carrier, which cylinder 102 is provided on the outside with a sleeve or a rubber blanket which in principle has the same construction described in FIG. 3D. The individual constituent parts and components of the device in this exemplary embodiment are disposed on the periphery of the cylinder surface and in principle have the same construction and the same function as in the exemplary embodiment according to FIG. 1D. They are provided with a designation which is increased by 100 and are not to be described in detail again at this point.

In order to equalize the temperature differences on the surface of the cylinder 102, due to the drying of the printing image with the aid of the dryers 20, 28 and 23, a metal belt 151 which is laid over two rotatable rolls 152 and 153 and makes large surface-area contact with the surface of the cylinder 102 in the region between the two rolls 152 and 153 is disposed downstream of the press nip 144 or downstream of the cleaning apparatus 135. The existing lateral temperature differences on the surface of the cylinder 102 are dissipated effectively in this way. In addition, the metal belt 151 is temperature controlled and is heated to a temperature slightly above the setpoint temperature $T_{Soll}$ by way of heating devices which can be situated in the interior of one or both of the rolls 152 and 153 or else in the region between the rolls, as indicated by way of the dashed illustration. Said heating device can be infrared heating rods which, in interaction with an absorbent inner coating of the metal belt 151, ensure a very satisfactory heat transfer onto the metal belt 151 and via the latter in turn onto the outer layer 71 of the intermediate carrier cylinder 102.

Figure 4D:
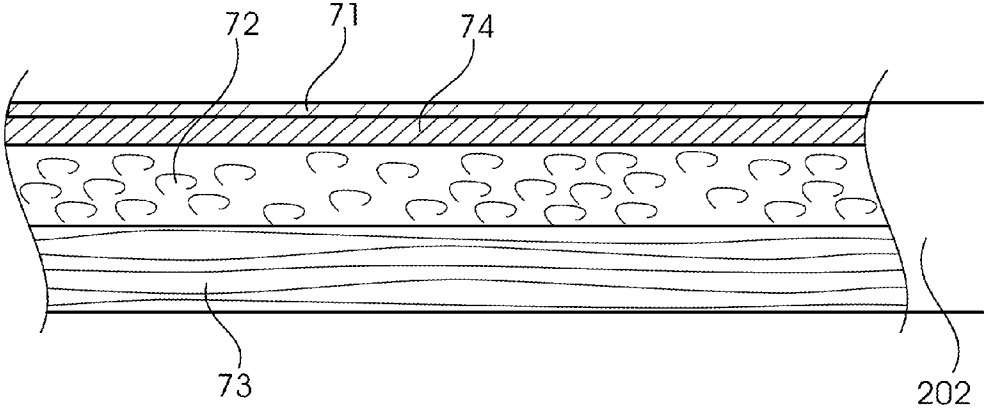

In a further exemplary embodiment of the invention, the outer layers of the intermediate carrier belt 2 from FIG. 1D or of the intermediate carrier cylinder 102 from FIG. 2*d* have the construction which is described in FIG. 4D. This differs from the construction according to FIG. 3D in that a metal layer 74 is inserted between the foam rubber layer 72 and the outer, for example silicone rubber, layer 71. Said metal layer 74 ensures the lateral temperature transport in the plane of the surface of the intermediate carrier 2 or 102. In the case of a construction of this type, the deflection rolls 51/52 in FIG. 1D and/or the metal belt 151 according to FIG. 2*d* can therefore be dispensed with. In addition, this solution has the advantage that the lateral temperature transport takes place in the plane of the intermediate carrier over its entire surface, that is to say even in the region, in which the dryers evaporate the water-based ink droplets 45 which are jetted on by the inkjet heads 16*a-d* or 116*a-d*, that is to say where the temperature inhomogeneities begin to be produced.

In addition, when the metal layer 74 is composed of ferromagnetic material, it is also possible to use it directly for heating the outer layer 71 of the intermediate carrier 2 or 102. To this end, the hot air dryer 19 can then be dispensed with and can be replaced instead by a dryer which heats the metal layer 74 by way of induction. In this way, a considerable amount of energy can be coupled into the outer layer of the intermediate carrier above the poorly thermally conducting foam rubber layer 72, with the result that in this way the water-based ink droplets 45 on the intermediate carrier 2 or 102 are dried with certainty before they reach the press nip 44.

It is assumed in the above-described exemplary embodiments that the temperature of the intermediate carrier surface is already to be relatively high when the intermediate carrier runs past under the inkjet heads, in order that the inkjet droplets which are jetted on immediately evaporate there. In the case of a different selected type of operation method, in which the intermediate carrier surface is rather not to have said high temperature, but rather runs under the heads in a "cold" state, in order to avoid clogging of the nozzles of the inkjet head which are then very narrow, for example, in particular in the case of high resolutions, the procedure can also be carried out differently. It is then namely expedient to cool the temperature of the intermediate carrier 2 or 102 between the press nip 44 and the point 5, from which the fluid application then takes place. This example is described in FIG. 5D. For this case, a temperature control device 61 is provided which supplies cooling liquid via the lines 66*a* and 66*b* to the deflection cylinder 51 which makes contact with the surface of the intermediate carrier 2. Moreover, the heat which is absorbed by the cylinder 51 is fed in via the lines 68*a* and 68*b* to a heat exchanger 67 which reuses the removed heat of the intermediate carrier 2. To this end, the heat exchanger 67 is installed into the feed air between the feed air connector 67*a* and the fan 20 for the hot air dryer 19. In this way, the heat loss which is produced by way of the cooling and reheating of the intermediate carrier belt 2 is kept within acceptable limits.

The procedure which is described can also be combined with a construction for the intermediate carrier 2, as shown in FIG. 4D. Depending on the operation method, that is to say whether the intermediate carrier 2 is heated or cooled by the deflection cylinder 51 downstream of the press nip, as described above, the thermal capacity of the layer 74 is selected which is situated below the ink-accepting functional layer 71. Said layer 74 serves not only for heat equalization or the homogenization of temperature differences in the outer ink-accepting layer 71. For the high-temperature case, that is to say the case where the intermediate carrier 2 is to run through under the inkjet heads at a relatively high temperature, a correspondingly high thermal capacity of the layer 74 which then serves as heat accumulator ensures that the heat which is introduced by the heating device, for example, upstream of the press nip 44 is retained in the intermediate carrier 2 and prevents cooling of the intermediate carrier surface 71 under the inkjet heads 16*a-d* during jetting on of the aqueous ink 45.

Figure 5D:
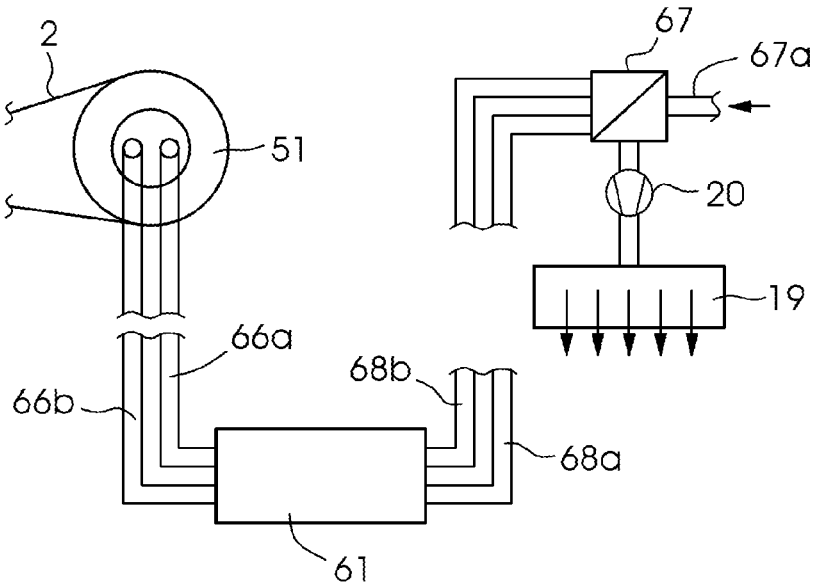
FIG. 5D shows a cooling device.

In the other case, in contrast, when the intermediate carrier 2 is cooled by the deflection cylinder 51 at the point as described using FIG. 5D, an intermediate carrier 2 is used instead, in which the layer 74 under the anti-adhesive cover layer 71 which is as thin as possible and onto which the ink is jetted has a comparatively low thermal capacity. This is because the surface of the intermediate carrier 2 can then be cooled sufficiently well and to a low temperature and permanently in its wraparound region around the deflection cylinder 51, without continuously flowing heat from the lower layers of the intermediate carrier belt 2 heating up the surface layer 71 again immediately before it has passed through under the inkjet heads 16*a-d*.

The thermal conductivity of the layer 71 can be set via its thickness and the material selection, in addition to the thermal capacity of the layer 74 which lies underneath, in such a way that the required quantity of heat can flow continuously under the inkjet heads 16*a-d*, which quantity of heat is already required upstream of the hot air dryer 19 for the evaporating or thickening of the printing liquid.

Figure 6D:
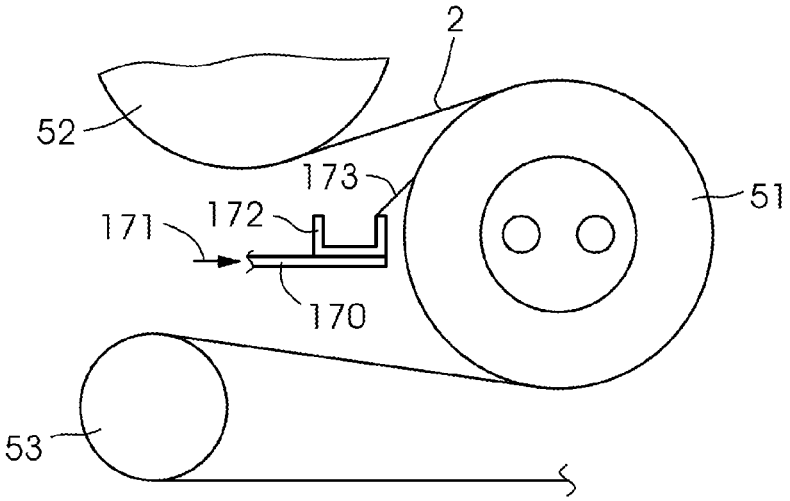
FIG. 6D shows a doctor device.

Furthermore, it has been determined when operating using the exemplary embodiment according to FIGS. 1D, 4D and 5D that the deflection cylinder 51 accepts ink very satisfactorily with its preferably metallic surface. Since it bears against the upper side of the intermediate carrier 2 in the region of the wraparound angle of said intermediate carrier 2, remaining ink residues which are not transferred onto the printing material in the press nip remain adhering to it, and it therefore also serves to clean ink residues from the surface of the intermediate carrier 2. To this end, as shown in FIG. 6D, measures are taken to utilize this effect. A collecting vessel 172 with a doctor blade 173 which is set against the surface of the deflection cylinder 51 by way of the advancing movement is situated on a carrier 120 which can be thrown on along the arrow 171 in the direction of the deflection cylinder. This can take place either continuously or at intervals during printing operation. In this way, the non-transferred ink residues which are removed from the surface of the intermediate carrier belt 2 are removed from the printing process. The separate cleaning apparatus which is designated by 35 in FIG. 1D and by 135 in FIG. 2*d* can then be dispensed with.

In the preceding text, the invention has been described in a device for indirect inkjet printing. However, it can likewise be used in an electrophotographically operating printing device which operates with an intermediate carrier, onto which the electrophotographically generated toner image is printed before it is printed over onto the actual printing substrate. In particular, the invention can also be used precisely in printing devices of the type which operate with liquid toner; the actual toner is therefore dispersed in an oil or hydrocarbon mixture (Isopar).

The ink which is printed by the print heads 16*a-d* is heated up to the operating temperature of preferably 80° C. on its path from the storage vessel 38 to the print heads 16*a-d* in FIG. 1 via a temperature control unit (not shown here) if high-temperature ink is used, at which operating temperature the print heads 16*a* to 16*d* are operated. The customary filters and means for degassing the ink which are used during inkjet printing and ensure that the print heads can perform their function without disruption and the nozzles cannot be blocked by particles or cannot be prevented from their pumping function by way of small gas bubbles are likewise not shown. Although the print heads 16*a* to 16*d* can also be temperature controlled separately to their operating temperature, it has been shown that a temperature equilibrium is set in the print heads 16*a-d* by way of temperature control of the ink itself which is pumped to and fro in a loop flow, for example, between the heads and the temperature control device and the temperature radiation which emanates from the belt 2 which is at a heat of approximately 120° C., which temperature equilibrium can readily be kept in a range between 70° C. and 90° C. without special shielding measures being required between the belt 2 and the print heads 16*a-d*.

The ink which is printed by the print heads 16*a* to 16*d* in FIG. 1 expediently has the following composition: from 5 to 20% of a colorant or pigment, from 5 to 20% of a polymer, into which the pigment or the colorant is dissolved or dispersed, from 60 to 90% of a polar solvent mixture with a water component of between 20 and 80%. As customary in the case of inkjet inks, from 0.05 to 3% of an anti-fungal means, such as benzoic acids or sulfonic acids, are added here which prevent the constituent parts of the printing liquid which are transferred onto the sheet 43, primarily the solidified polymer which contains the colorants or pigments, being attacked by fungus. The following composition was selected in one exemplary embodiment for the ink:

14.6% pigment,

10% styrene methacrylic acid copolymer with polyethylene glycol side chains,

75% aqueous solvent consisting of a mixture of isoamyl alcohol, water and 1-methoxy-2-propanol in the ratio 1:1:1, and 0.4% benzoic acid.

Using these and functionally similar compositions of the ink, the device which is described using FIG. 1 for indirect inkjet printing can be operated in such a way that purging of the nozzles of the print heads 16*a-d* becomes necessary only at very great intervals, without the inkjet nozzles becoming clogged. The times now lie in the double-digit minute range compared with times in the double-digit second range, as occurred according to the prior art.

The invention claimed is:

1. A method for the indirect application of printing liquid onto a printing material, the method comprising the following steps:

providing an intermediate carrier having an outer layer with a relatively low thermal conductivity;

applying a printing liquid on the intermediate carrier only at printing points corresponding to a printing image in an inkjet method;

heating the printing liquid;

transferring the printing liquid or its evaporated remaining ink layer in a press nip from the intermediate carrier onto the printing material;

heating the intermediate carrier locally at the points at which the printing image is to be subsequently applied or has already been applied before the application of the printing liquid; and applying a conditioning medium after the heating step and before the step of applying the printing liquid.

2. A device for the indirect application of printing liquid onto a printing material, the device comprising:

an intermediate carrier having one or more layers with a relatively low thermal conductivity, a surface and a movement direction;

an inkjet application apparatus configured to apply a printing liquid onto said intermediate carrier only at printing points corresponding to a printing image;

a press nip configured to transfer the printing liquid or an ink film remaining after evaporation of the printing liquid, from the intermediate carrier onto the printing material;

a heating apparatus configured to heat the printing liquid, said heating apparatus including one or more radiation sources configured to heat at least one of said surface of said intermediate carrier or the printing liquid or an ink layer at the printing image points, said radiation sources being disposed upstream of said inkjet application apparatus in said movement direction of said intermediate carrier; and an apparatus for applying a conditioning medium downstream of said heating apparatus and upstream of said inkjet application apparatus.

3. The method according to claim 1, which further comprises jetting the ink onto the intermediate carrier, and carrying out the step of heating the intermediate carrier locally by way of radiation only at the image points at least one of before the ink is jetted on or directly upstream of the press nip.

4. The method according to claim 1, which further comprises carrying out the step of applying the printing liquid on the intermediate carrier in droplets by using inkjet heads, writing a positive thermal image onto a surface of the intermediate carrier upstream of the inkjet heads in a movement direction of the intermediate carrier by using a correspondingly controlled infrared laser diode array, and beginning an evaporation of the droplets on the positive thermal image after being jetted on.

5. The method according to claim 4, which further comprises additionally evaporating a water-based conditioner which was also applied upstream of the inkjet heads.

6. The method according to claim 4, which further comprises during the evaporation step, cooling down an inscribed positive thermal image to assume approximately the same temperature as non-image points onto which no ink is jetted.

7. The method according to claim 1, which further comprises providing a belt as the intermediate carrier, carrying out the step of applying the printing liquid on the belt by using inkjet heads having nozzles, and providing the belt with surface regions having a comparatively low temperature, lying opposite the nozzles in non-image points being situated directly above the belt and being used more rarely than the nozzles in the image points.

8. The method according to claim 1, wherein the intermediate carrier is a belt or coated or covered cylinder being heated in a targeted manner precisely at a point at which an image point is to be applied.

9. The method according to claim 1, which further comprises pinning, curing, surface drying or completely drying conditioner liquids, primers or functional coatings being applied onto the intermediate carrier before the ink is printed on at image points where the ink is subsequently jetted on.

10. The method according to claim 1, which further comprises heating the printing image which has already been solidified and has cooled in comparison with surrounding non-image points during an evaporation of water in the ink before the transfer from the intermediate carrier onto the printing material, and carrying out the heating with radiation energy in a targeted manner only at the image points.

11. The method according to claim 1, which further comprises providing a belt as the intermediate carrier, raising a temperature of a negative thermal image which has already been written into a surface of the belt as a result of evaporation of a solvent or water of the ink to a temperature level of surrounding non-image points by applying radiation additionally only at those points.

12. The method according to claim 1, which further comprises heating solidified ink of the image points into a desired temperature range being optimum for a transfer of the ink image from the intermediate carrier onto paper.

13. The method according to claim 1, which further comprises carrying out the step of applying the printing liquid on the intermediate carrier in printer dots, and setting a viscosity or a phase of the printer dots to be transferred before they are transferred onto the printing material in the press nip.

14. The method according to claim 1, which further comprises radiating the intermediate carrier in a manner being dependent on an image upstream of the press nip, in accordance with a speed of movement of the intermediate carrier to maintain a defined finite time between the radiation and the entry into the press nip being typical for a glass transition for a polymer of the printing liquid in an evaporated state.

15. The method according to claim 1, which further comprises making at least one of the printing liquid or a coating of the intermediate carrier light-absorbing.

16. The method according to claim 1, which further comprises adding absorber substances which absorb infrared or near-infrared radiation to the printing liquids, and applying targeted IR radiation upstream of the press nip.

17. The method according to claim 1, which further comprises providing a surface of the intermediate carrier with an infrared or near-infrared absorbency.

18. The method according to claim 1, which further comprises carrying out the step of applying the printing liquid on the intermediate carrier by using inkjet heads, firstly imparting a positive thermal image into a surface of the intermediate carrier before the surface reaches the inkjet heads, additionally neutralizing a negative thermal image by applying radiation upstream of the press nip, and producing the negative thermal image during an evaporation of a water constituent part of the ink or heating the solidified printing liquid at the press nip.

19. The method according to claim 1, which further comprises carrying out the step of applying the printing liquid on the intermediate carrier by using inkjet heads, and cooling the intermediate carrier after the transfer of the ink image onto the printing material and before an application of a new image onto the intermediate carrier, in order to set temperatures for the intermediate carrier which are not too high and can be controlled in a following region below the print heads.

20. The method according to claim 1, which further comprises providing a belt as the intermediate carrier, and guiding the belt over cooled deflection rolls with a wrap-around angle.

21. The method according to claim 20, which further comprises providing the deflection rolls as cylinders making contact with a surface of the belt and being formed of a thermally conducting material selected from the group consisting of metal, thermally conducting ceramic and thermally conducting plastic.

22. The method according to claim 1, which further comprises providing the intermediate carrier as a cylinder having a surface being brought into contact with a cooled or temperature-controlled thermally conducting metal belt for effectively dissipating quantities of heat from an outer layer of the intermediate carrier as a result of a full-surface contact.

23. The method according to claim 1, which further comprises carrying out the step of heating the printing liquid by using a radiation source selected from the group consisting of:

diodes or diode arrays emitting infrared light with sufficient resolution to heat only the image points on the intermediate carrier;

lasers or pulsed lasers being operated in a scanning mode to scan the intermediate carrier transversely with respect to a process direction and being switched on only where an image point is also situated; and edge-emitter diode laser arrays or VCSEL arrays or lasers being coupled to fiber bundles in which a coupling is enabled only for fibers having an end aimed at an image point.

24. The device according to claim 2, wherein said application apparatus jets the ink onto said intermediate carrier, and said heating apparatus heats said intermediate carrier locally by way of radiation only at the image points at least one of before the ink is jetted on or directly upstream of said press nip.

25. The device according to claim 2, wherein said application apparatus applies the printing liquid on said intermediate carrier in droplets by using inkjet heads, a correspondingly controlled infrared laser diode array writes a positive thermal image onto a surface of said intermediate carrier upstream of said inkjet heads in a movement direction of said intermediate carrier, and said heating apparatus begins an evaporation of the droplets on a positive thermal image after being jetted on.

26. The device according to claim 25, wherein said heating apparatus additionally evaporates a water-based conditioner which was also applied upstream of said inkjet heads.

27. The device according to claim 25, wherein said heating apparatus cools down an inscribed positive thermal image during the evaporation to assume approximately the same temperature as non-image points onto which no ink is jetted.

28. The device according to claim 2, wherein said intermediate carrier is a belt, inkjet heads having nozzles apply the printing liquid on said belt, and said belt has surface regions with a comparatively low temperature, lying opposite said nozzles in non-image points being situated directly above said belt and being used more rarely than said nozzles in the image points.

29. The device according to claim 2, wherein said intermediate carrier is a belt or a coated or covered cylinder being heated in a targeted manner precisely at a point at which an image point is to be applied.

30. The device according to claim 2, wherein said heating apparatus pins, cures, surface dries or completely dries conditioner liquids, primers or functional coatings being applied onto said intermediate carrier before the ink is printed on at image points where the ink is subsequently jetted on.

31. The device according to claim 2, wherein said heating apparatus heats the printing image which has already been solidified and has cooled in comparison with surrounding non-image points during an evaporation of water in the ink before the transfer from said intermediate carrier onto the printing material, and said heating apparatus heats with radiation energy in a targeted manner only at the image points.

32. The device according to claim 2, wherein said intermediate carrier is a belt, and said heating apparatus raises a temperature of a negative thermal image which has already been written into a surface of said belt as a result of evaporation of a solvent or water of the ink to a temperature level of surrounding non-image points by applying radiation additionally only at those points.

33. The device according to claim 2, wherein said heating apparatus heats solidified ink of the image points into a desired temperature range being optimum for a transfer of the ink image from said intermediate carrier onto paper.

34. The device according to claim 2, wherein said application apparatus applies the printing liquid on said intermediate carrier in printer dots, and said heating apparatus sets a viscosity or a phase of the printer dots to be transferred before they are transferred onto the printing material in said press nip.

35. The device according to claim 2, wherein said heating apparatus radiates said intermediate carrier in a manner being dependent on an image upstream of said press nip, in accordance with a speed of movement of said intermediate carrier to maintain a defined finite time between radiation and entry into said press nip being typical for a glass transition for a polymer of the printing liquid in an evaporated state.

36. The device according to claim 2, wherein at least one of the printing liquid or a coating of said intermediate carrier is light-absorbing.

37. The device according to claim 2, which further comprises absorber substances being added to the printing liquid, said absorber substances absorbing infrared or near-infrared radiation, and said heating apparatus applying targeted IR radiation upstream of said press nip.

38. The device according to claim 2, wherein said intermediate carrier has a surface with an infrared or near-infrared absorbency.

39. The device according to claim 2, wherein said application apparatus has inkjet heads applying the printing liquid on said intermediate carrier, said intermediate carrier has a surface, and said heating apparatus firstly imparts a positive thermal image into said surface of said intermediate carrier before said surface reaches said inkjet heads, additionally neutralizes a negative thermal image by applying radiation upstream of said press nip, and produces the negative thermal image during an evaporation of a water constituent part of the ink or heats the solidified printing liquid at said press nip.

40. The device according to claim 2, wherein said application apparatus has inkjet heads applying the printing liquid on said intermediate carrier, and a cooling device cools said intermediate carrier after the transfer of the ink image onto the printing material and before an application of a new image onto said intermediate carrier, in order to set temperatures for said intermediate carrier which are not too high and can be controlled in a following region below said print heads.

41. The device according to claim 2, which further comprises cooled deflection rolls, said intermediate carrier being a belt guided over said cooled deflection rolls with a wraparound angle.

42. The device according to claim 41, wherein said belt has a surface, and said deflection rolls are cylinders making contact with said surface of said belt and being formed of a thermally conducting material selected from the group consisting of metal, thermally conducting ceramic and thermally conducting plastic.

43. The device according to claim 2, wherein said intermediate carrier is a cylinder having a surface and an outer layer, and a cooled or temperature-controlled thermally conducting metal belt is brought into contact with said surface of said cylinder for effectively dissipating quantities of heat from said outer layer of said intermediate carrier as a result of a full-surface contact.

44. The device according to claim 2, wherein said heating apparatus is a radiation source heating the printing liquid and being selected from the group consisting of:

diodes or diode arrays emitting infrared light with sufficient resolution to heat only the image points on said intermediate carrier;

lasers or pulsed lasers being operated in a scanning mode to scan said intermediate carrier transversely with respect to a process direction and being switched on only where an image point is also situated; and edge-emitter diode laser arrays or VCSEL arrays or lasers being coupled to fiber bundles in which a coupling is enabled only for fibers having an end aimed at an image point.

* * * * *